US005749022A

United States Patent [19]

Kikui et al.

[11] Patent Number: 5,749,022

[45] Date of Patent: May 5, 1998

[54] CHARGING APPARATUS AND METHOD FOR USE IN IMAGE FORMING DEVICE

[75] Inventors: Shinsuke Kikui, Yokohama; Wataru Yasuda, Tokyo; Ichiro Shimeki; Naomi Sugimoto, both of Kawasaki, all of Japan

[73] Assignee: Ricoh Company, Ltd., Tokyo, Japan

[21] Appl. No.: 729,756

[22] Filed: Oct. 7, 1996

[30] Foreign Application Priority Data

Oct. 5, 1995 [JP] Japan ..... 7-286503
Dec. 4, 1995 [JP] Japan ..... 7-315186

[51] Int. Cl.[6] ..... G03G 15/02

[52] U.S. Cl. ..... 399/50; 399/174; 399/176; 399/44; 399/51; 361/225

[58] Field of Search ..... 399/174, 175, 399/176, 168, 50, 44, 51, 53; 361/225

[56] References Cited

U.S. PATENT DOCUMENTS 5,457,522 10/1995 Haneda ..... 361/225 X
5,499,080 3/1996 Furuya et al. .
5,606,399 2/1997 Kikui ..... 399/168
5,649,265 7/1997 Tabuchi ..... 399/44

OTHER PUBLICATIONS

*Patent Abstracts of Japan*, vol. 17, No. 341 (P1565), Published Jun. 28, 1993, for JP–A–0546001, Published Feb. 26, 1993.

*Patent Abstracts of Japan*, vol. 16, No. 511 (P1441), Published Oct. 21, 1992, for JP–A–04186381, Published Jul. 3, 1992.

*Primary Examiner*—R. L. Moses

*Attorney, Agent, or Firm*—Oblon, Spivak, McClelland, Maier & Neustadt, P.C.

[57] ABSTRACT

A charging apparatus and method used in an image forming apparatus uses a charging apparatus to apply a charging potential to a photosensitive body, a voltage measuring device that measures the charging potential and outputs a measured charging potential signal, an environmental condition sensor which senses at least one environmental condition and outputs an environmental condition signal, and adjustable voltage application which applies an applied voltage to said charging member, and a controller, where the controller controls an amount of the applied voltage applied to the charging member in accordance with the charging potential signal and the environmental signal, where the applied voltage is adjusted to compensate for the sensed environmental condition.

28 Claims, 16 Drawing Sheets

○: PHOTOSENSITIVE BODY AND ROLLER BOTH AFTER 120000 SHEETS COPYING

✱: NEW PHOTOSENSITIVE BODY AND NEW ROLLER

□: PHOTOSENSITIVE BODY AFTER 120000 SHEETS COPYING AND NEW ROLLER

△: NEW PHOTOSENSITIVE BODY AND ROLLER AFTER 120000 SHEETS COPYING

FIG. 19

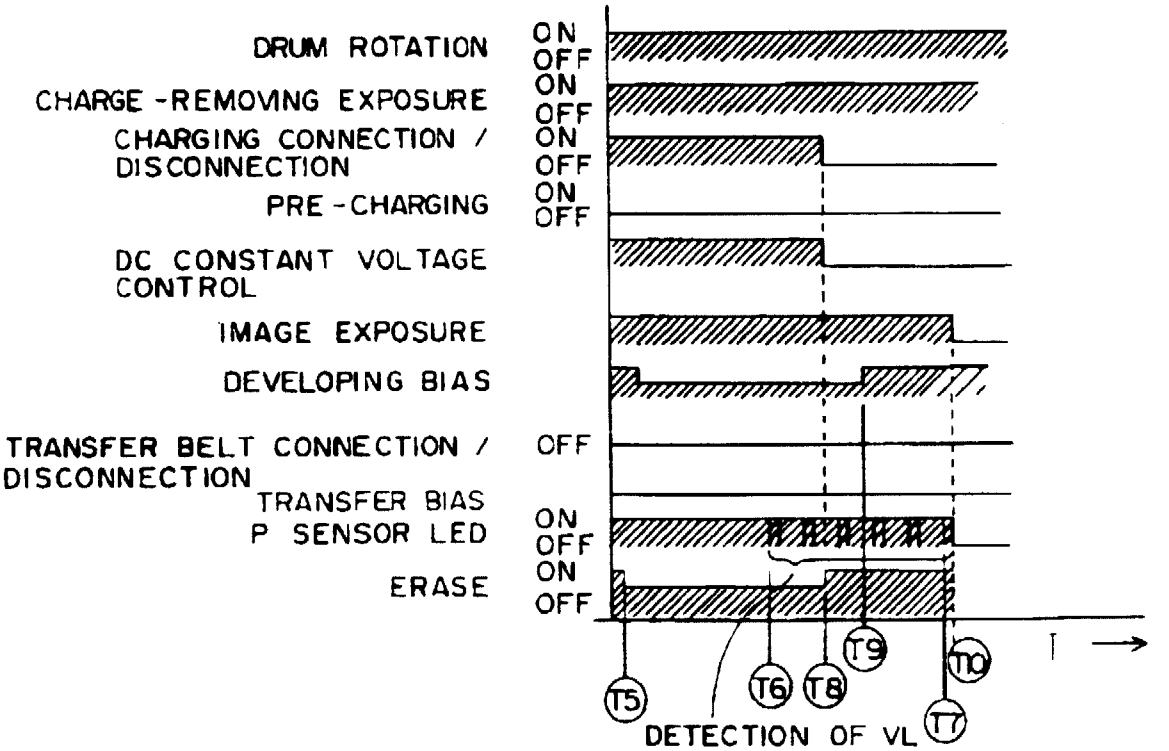

T5: ERASER IS CHANGED OVER FROM "ENTIRE SURFACE ERASING" TO "VL PATTERN ERASING" PATTERN FORMING IS STARTED, DEVLOPING BIAS IS TRANSFERRED FROM NON-IMAGE FORMING BIAS TO VL STANDARD BIAS.

T6: VL PATTERN IS DETECTED AT CONSTANT INTERVALS SEVERAL TIMES BY USE OF OPTICAL SENSOR.

T8: ERASING: ALL LIT UP, CHARGING CONNECTION/DISCONNECTION: OFF, DC CONSTANT VOLTAGE CONTROL: OFF

T9: DEVELOPING IS CHANGED OVER TO NON-IMAGE FORMING AREA BIAS.

T10: AFTER FINISHING VL PATTERN READING-OUT, OPTICAL SENSOR: OFF, ERASING: OFF

CHARGING APPARATUS AND METHOD FOR USE IN IMAGE FORMING DEVICE

BACKGROUND OF THE INVENTION

1. Field of the Invention

The present invention relates to a charging apparatus and an electrophotographic image forming apparatus by use of the charging apparatus. The charging apparatus is a contact-type charging member such as charging roller, charging belt, etc. for charging a photosensitive body in the electrophotographic image forming apparatus such as an analog or digital (PPC) copying machine, a facsimile device, a printer, or the like.

2. Discussion of the Background

In general, in the field of charging apparatus' for uniformly charging a photosensitive body of the electrophotographic-type used in image forming apparatus', there has been proposed a contact-type charging roller apparatus that emits a small amount of ozone.

In such charging apparatus, since the charging is done by the action of electric discharging occurring in a gap existing between a charging roller and the photosensitive body, the applied voltage can be made lower compared with the case of corona discharging, and thereby an amount of emitted ozone can be reduced.

On the other hand, since the electric potential in the above-mentioned gap largely depends on the electric properties of the charging roller, there arises a problem to be solved that the charging potential tends to be largely changed due to the variation of the ambient environment.

For this reason, regarding the conventional contact-type charging apparatus, there has been already proposed a charging apparatus in which the temperature of the contact-type charging member is detected and thereby a voltage applying medium is controlled on the basis of the value obtained by judging the previously set voltage applying condition. (See, e.g., Japanese Laid-open Patent Publication No. 4-186381/1992.)

An example of such conventional technology (prior art) is described hereinafter.

FIG. 9 is a general structure view for explaining the prior art charging roller.

An electrically conductive layer 2*a* of the charging roller needs to have an elasticity because the conductive layer 2*a* has to be subsequently rotated together with the photosensitive body 1. For this reason, a conductive rubber material is generally used for the conductive layer 2*a*.

It has been well known generally that the electric conductivity of the rubber material tends to be changed due to the variation of the ambient environment. Namely, the electric conductivity thereof becomes large under the condition of high temperature/high humidity, while the same becomes small under the condition of low temperature/low humidity.

In general, since the temperature and the relative humidity vary together in relation to each other, in the above proposed apparatus, the temperature of the charging roller is detected, the peak-to-peak value of the alternating current AC applied voltage is made variable in accordance with the detected temperature, and thereby the unevenness of the charging can be prevented by obtaining an optimum applied voltage of the charging roller.

In the image forming apparatus employing such charging apparatus as mentioned above, a corona charger has been used for charging the photosensitive body. However, a problem of emitting ozone arises. Recently, it has been proposed that a contact-type charging method in which the charging roller or the charging belt capable of charging the photosensitive body to a desired potential with comparatively low voltage is employed instead of the corona charger.

In such situations, using the contact-type charging method, an electrically conductive rubber of medium resistance value is commonly employed as the charging member. However, it is difficult to control the resistance of the rubber having medium resistance value. And further, due to the dependence on the ambient environment (in particular, the variation of the charging potential due to the temperature variation) being considerably large, it has been proposed that the charging potential is controlled to a desired value by heating the charging member in order to always keep constant the amount of water contained therein, or by adjusting the applied voltage in accordance with the detected temperature, or by adjusting the applied voltage in accordance with the detected humidity. On the other hand, since deterioration over time due to film (layer) thickness variation may occur on the photosensitive body to be charged, it is necessary to control the surface potential over time.

In the published specification of Japanese Laid-open Patent Publication No. 4-9883/1992, it has already been proposed that the direct current (DC) constant current control be done for the charging member on the non-image area. The DC voltage is detected when the charging member is on the non-image area, and the control of the DC constant voltage is done at a charging power supply circuit so as to cause the voltage of the charging member to become the before-mentioned detected DC voltage during the time period when the charging member is opposed to (i.e., faces) the image area on the surface of the photosensitive body (i.e., the area employed for the image formation).

Furthermore, in Japanese Laid-open Patent Publication component of the current flowing through the route between the charging member and the photosensitive body at the charging process is detected and an amount of exposed light rays is controlled in accordance with the detected current, thereby stabilizing the writing-in potential for the latent image.

Furthermore, in Japanese Laid-open Patent Publication No. 5-27557 (1993), proposes detecting the amount of a layer scrapped off the photosensitive body and the voltage to be applied to the charging roller brought into direct contact with the photosensitive body is lowered in accordance with the increase of the amount by which the layer is scrapped off.

Conventionally, it is necessary to perform the compensation, respectively, for the deterioration of the photosensitive body over time and the environmental variation of the charging member, and various controls have been done hitherto in order to keep stable the surface potential of the photosensitive body.

However, the detection accuracy of the condition amounts (e.g., temperature and humidity of the charging roller, the current value, and the amount by which the photosensitive body has been scraped of) is comparatively low, the reliability of controlling the image forming parameters corresponding to the above-mentioned condition amounts detected (applied voltage applied to the charging roller, and exposed light ray amount) is comparatively low for the desired image quality (recording density).

In addition, since the other condition amounts excluding the above-mentioned condition amounts (for instance, toner density) also exerts an influence upon the image quality, there exists insufficient information (defect) to completely and adequately improve and stabilize the image quality, regarding the conventional (prior-art) apparatus.

Furthermore, there exists a toner density controlling apparatus in which a pattern of the toner image is formed on the photosensitive body, the amount of toner attachment on the above pattern is detected, and when the amount of toner attachment is insufficient, the toner is supplemented by the developing unit. However, in case that the charging potential is unstable (of low reliability) at the time of forming the toner image pattern, an inadequate toner pattern is formed on the basis of the unstable surface potential of the photosensitive body. Consequently, the toner density control cannot be performed normally.

And further, aiming at the reduction of the background dirt, etc. caused by the deterioration of the photosensitive body over time, the dirt of the optical system, and the lowering of the light rays amount (intensity) due to the deterioration of the lamp employed in the so-called analog-type copying machine or the scanner in which the manuscript document is illuminated by the exposing lamp and the light rays reflected on the surface of the manuscript document are guided to the photosensitive body, there has been already proposed a method of exposing the photosensitive body by the light rays in accordance with the standard density pattern, reading out the amount of the toner attachment on the photosensitive body after the developing operation thereon by use of an optical sensor, and controlling the exposing lamp voltage in the case of (the image forming apparatus in) the analog copying machine or the digital scanner or controlling the laser light rays emitting intensity in the case of (that in) the laser printer.

On this occasion also, since the control is performed on the basis of the surface potential of the photosensitive body after the charging and exposing procedures, there arises a problem to be solved that the surface potential of the photosensitive body may become unstable due to the environmental variation.

As is recognized and addressed by the present invention, when an AC voltage is applied to the charging apparatus, there arises a problem that a sound of vibration is emitted from the charging member. On the contrary, when a DC voltage is applied to the charging apparatus instead of the AC voltage, although the sound of vibration is not emitted therefrom, not only the applied voltages A–A" (as shown in FIG. 7) to be applied at the time of starting the charging operation but the inclination thereof may change in accordance with the temperature variation in the charging characteristic showing the relationship between the applied voltage (–V) and the charging potential on the photosensitive body (–V) as shown in FIG. 7.

Consequently, as recognized herein, a problem arises of controlling the lowered potential on the photosensitive body, assuming the applied voltage is compensated for based on the temperature.

Furthermore, in addition to the temperature variation, since the charging amount may also change in accordance with the humidity variation as shown in FIG. 8, there arises a problem to be solved that the sufficient control of the potential on the photosensitive body cannot be attained only by performing the compensation for the temperature variation.

Furthermore, in the aforementioned situation, the deterioration of the image quality caused by the environment dependability of the charging member and the deterioration over time of the photosensitive body has to be suppressed and thereby the image quality may be further improved and stabilized.

SUMMARY OF THE INVENTION

Accordingly, one object of this invention is to provide a novel method and system for employing a charging apparatus that overcomes the above-mentioned limitations of existing methods and systems.

It is another object of the present invention to provide a charging apparatus capable of easily and stably controlling the charging potential regardless of the variation in the environmental conditions such as temperature, humidity, etc. so to improve image forming quality.

It is still another object of the present invention to provide a charging apparatus capable of easily and stably controlling the charging potential even though the environmental condition excluding the temperature, but including, for instance, the humidity, changes considerably so to improve image forming quality.

It is still another object of the present invention to suppress the deterioration of the image quality caused by the environmental dependability and the charging member and the deterioration of the photosensitive body over time so to improve image forming quality.

It is still another object of the present invention to provide an electrophotographic image forming apparatus employing the charging apparatus as mentioned above capable of suppressing the deterioration of the image quality caused by the environmental dependability of the charging member such as temperature, humidity, etc., and the deterioration of the photosensitive body over time so to improve image forming quality.

In order to attain the above-mentioned objects, the charging apparatus in the image forming apparatus of the first embodiment according to the present invention includes a charging member brought into contact with a photosensitive body, a voltage applying medium for applying voltage to the charging member, a control medium for controlling voltage applied to the charging member, and temperature detection means for detecting the temperature of the charging member.

The charging apparatus is a contact-type charging apparatus in which the voltage applied to the charging member is compensated in accordance with the detection temperature detected by the temperature detection medium. The charging apparatus further includes a measuring medium for measuring the charging potential of the photosensitive body.

The charging potential created by applying voltage at one point or plural points previously decided is detected, a voltage to be applied which is needed for making the charging potential of the photosensitive equal to a target potential is obtained by the detected charging potential, and the difference between the obtained voltage to be applied and a compensation voltage to be applied in accordance with the detected temperature at that time is detected.

The charging apparatus is provided with a compensation mode of compensating a compensation rule of the applied voltage based on the detected temperature in accordance with the difference.

It is also preferable that, in a charging method by use of the charging apparatus as defined above, the compensation due to the compensation rule of the applied voltage on the basis of the detected temperature is performed by adding the detected difference value to the compensation voltage to be applied in accordance with the detected temperature.

It is also preferable that the charging method by use of the charging apparatus as defined above comprises steps of providing a plurality of compensation rules of the applied voltage on the basis of the detected temperature and performing the compensation of the compensation rule of the applied voltage on the basis of the detected temperature by selecting the compensation rule of the applied voltage in accordance with the detected difference value.

Other embodiments of the present invention are explained with reference to FIGS. 10–12 and include a photosensitive body (101), a charging member (102) brought into contact with the photosensitive body (101), a power supply medium (130, FIG. 11, or charging electric power source circuit in FIG. 12) for applying voltage to the charging member (102) in order to charge the photosensitive body (101), an exposing apparatus (medium) (108) for exposing the charging surface of the photosensitive body (101) with image light and thereby forming an electrostatic latent image on a charging surface of the photosensitive body, and a developing medium (110) for creating a visible image from the electrostatic latent image formed by the exposing medium (108).

The image forming apparatus further includes a surface potential detecting medium (105) for detecting a surface potential on the photosensitive body (101), a correlation obtaining medium (incorporating a central processing unit, CPU 160) for selectively applying plural levels of voltages to the charging member through the power supply medium (130), reading out the detection value of the surface potential of the photosensitive body (101) created by applying the respective voltages thereto which is detected by the surface potential detecting medium (105), and obtaining the correlation of the applied voltage versus the surface potential, and a voltage applying medium (which uses the central processing unit, CPU, 160) for applying voltage to the charging member (102) through the power supply medium (130) in order to form a predetermined surface potential in accordance with the correlation on an area for exposing the image light rays thereon.

In the above description, the reference numerals in the parenthesis correspond to the elements in the below-mentioned embodiments and are attached to the respective elements to reference for easy understand the contents of the embodiments.

According to those embodiments, the correlation of the applied voltage Vap versus the surface potential Vch, for instance, as shown by the graph of FIG. 15, can be obtained by the voltage applying medium with the CPU (160). The charging potential VchP which is desired, or set in hardware, is used in the above correlation to obtain the voltage VapP to be applied to the charging member (102) in order to get the potential VchP.

In the image forming apparatus according to the present invention, the voltage applying medium with the CPU (160) applies the voltage VapP to be applied for forming the predetermined surface potential VchP to the charging member (102) through the power supply medium (130) in accordance with the above-mentioned correlation in the area to be exposed with the image light rays.

Consequently, the applied voltage VapP is established in accordance with the charging potential forming characteristic (above correlation) between the charging member (102) and the photosensitive body (101) determined by condition (state) of the charging member (102) and the photosensitive body (101) at the respective time points of forming the image, and thereby the surface potential Vchp as intended can be obtained. Namely, the surface charging potential of the photosensitive body (101) can be stabilized.

As shown by the four lines in the graph of FIG. 15, not only does the charging potential forming characteristic (above correlation) change due to the use of the photosensitive body (101) and the charging member (102) over time, but the same changes are also effected by water containing quantity and temperature of the photosensitive body (101) and the charging member (102). Such changes are rapid and comparatively frequent. For instance, immediately after the power supply medium (130) is turned on in the early morning of winter, there is a high possibility of low-temperature/high-humidity. On the contrary, immediately before close of business, there is a high possibility of high-temperature/low-humidity.

According to the present invention, such problems are automatically improved.

Furthermore, in the second embodiment according to the present invention, the pattern of the toner image formed on the photosensitive body (101) and the amount of toner attached to the formed pattern is detected. When the detected amount of toner is insufficient, toner is supplemented into the developing medium (110).

In the toner density control, even when the toner image pattern is formed, the applied voltage to form the surface potential for detecting the toner density is obtained on the basis of the charging potential forming characteristic (correlation) between the charging member (102) and the photosensitive body (101), and the obtained voltage applied to the charging member (102). In such manner, the toner density pattern latent image of constant potential is formed on the photosensitive body (101), and the reliability of the toner density control becomes high.

Furthermore, in the third embodiment according to the present invention, a standard density pattern aiming at the reduction of the dirt on the background of the formed image, etc. caused by sensitivity deterioration of the photosensitive body (101) over time, the dirt in the optical system, the lowering of the light rays amount (intensity) due to the deterioration of the lamp, or the like is exposed on the photosensitive body (101). The amount of the toner attached to the photosensitive body (101) after developing the latent image is then read out by the optical sensor, and the exposing intensity is controlled so as to make constant the amount of the toner attached thereto.

In such situation, even when the standard density pattern toner image is formed, the voltage to be applied for testing the exposure intensity is applied to the charging member (102) on the basis of the charging potential forming characteristic (correlation) between the charging member (102) and the photosensitive body (101).

According to such method, a pattern latent image for testing the exposure intensity of constant potential can be formed, and the reliability of the exposure intensity control can be made high.

The other objects and characteristics of the present invention may be made clear from the following explanation of the first through fourth embodiments referring to the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 19 is a timing diagram showing the operational timing of the image forming mechanism under the control of the CPU of the fourth embodiment.

DETAILED DESCRIPTION OF THE PREFERRED EMBODIMENTS

A more complete appreciation of the invention and many of the attendant advantages thereof will be readily obtained as the same becomes better understood by reference to the following detailed description when considered in connection with the accompanying drawings.

[First Embodiment]

Figure 1:
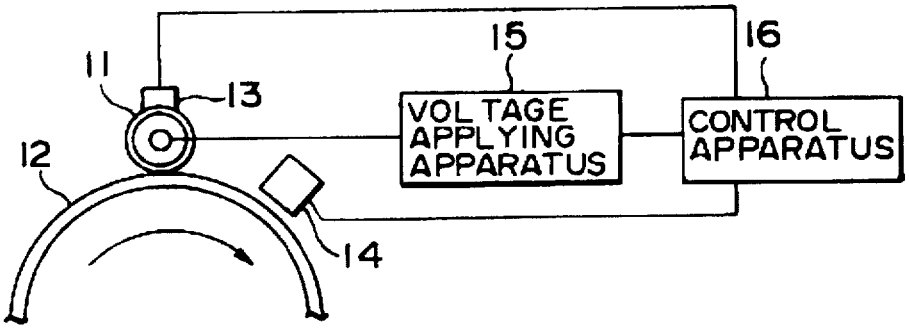
FIG. 1 is a block diagram showing a charging portion of an electrophotographic copying machine of the first embodiment according to the present invention.

FIG. 1, a general description is made for a copy machine according to an embodiment of this invention. A charging roller (member) 11 is set in contact with a photosensitive body 12, applies a voltage from a voltage applying device 15 to charge a surface of the above photosensitive body 12 uniformly. The photosensitive body 12, shown is in a drum form (although belts and other media are contemplated) rotates in a clockwise direction. It is known that components are arranged to execute an electrophotography process around the photosensitive body 12 in its rotating direction including the above charging roller 11, an exposing portion, a developing unit, a transfer/separation unit to a copying paper, a cleaning unit, and a charge removing unit in this order.

The voltage applying device 15 applies a voltage to the charging roller 11 under control of the control means 16. A temperature detection device 13 detects a temperature of the charging roller 11, wherein the charging apparatus is a contact-type charging apparatus in which the voltage applied to the charging roller is compensated in accordance with the detection temperature detected by the temperature detection device 13. The charging apparatus further includes a potential sensor 14 for measuring a charging potential of the photosensitive body, wherein the charging potential created by applying voltage at predetermined one or plural points is detected. A voltage to be applied required for making the charging potential of the photosensitive body equal to a target potential is obtained based on the detected charging potential, and the difference between the obtained voltage to be applied and a compensated applied voltage based on the detected temperature at that time is detected. The charging apparatus is also provided with a compensation mode of compensating a compensation rule of the applied voltage based on the detection temperature in accordance with the detected difference.

The above charging roller 11 includes, for example, an epichlorohydrin rubber roller or a roller having a coating film on its surface made of fluoroplastic with hydrin rubber and silica dispersed thereon.

Figure 7:
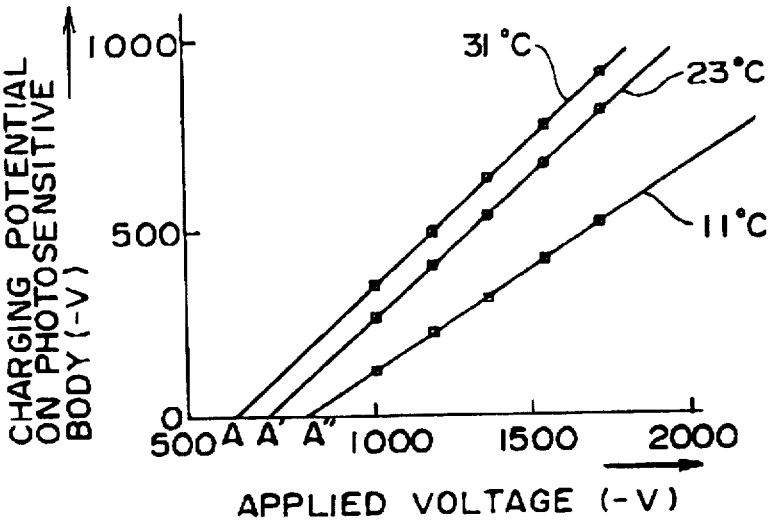
FIG. 7 is a graph showing a relationship between the charging potential on the photosensitive body versus applied voltage at the different temperatures.
Figure 8:
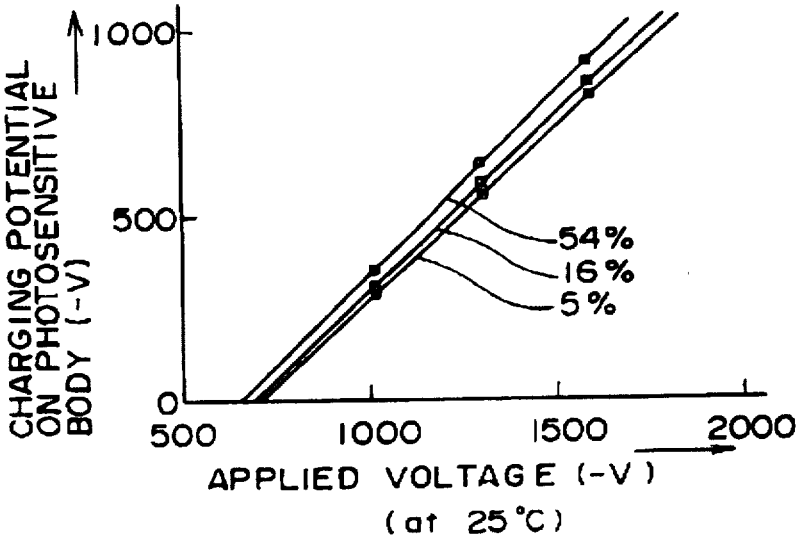
FIG. 8 is a graph showing a relationship between the charging potential on the photosensitive body versus applied voltage at the different humidities.
Figure 9:
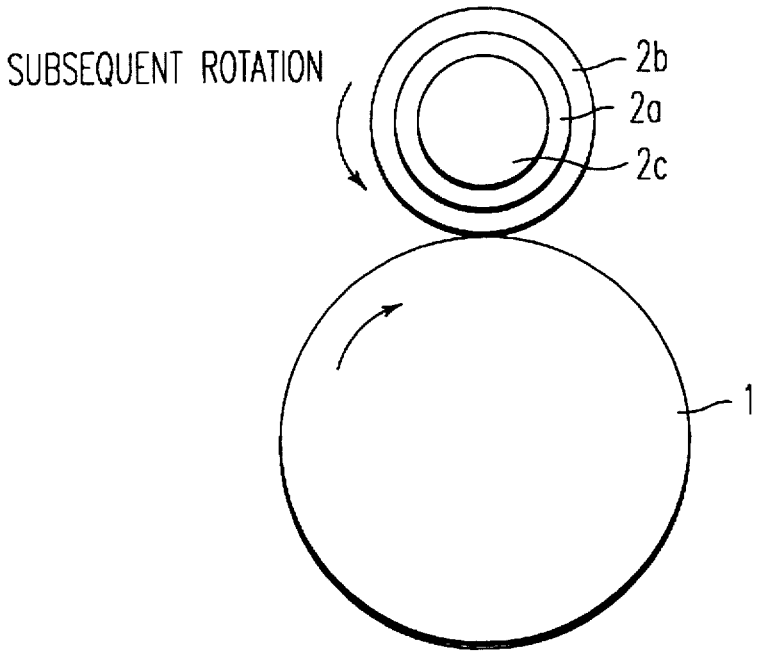
FIG. 9 PRIOR ART
FIG. 9 is a front view of a general charging roller.

The charging characteristics depend on the temperature of the roller as shown in FIG. 7, and also depend on the humidity as shown in FIG. 8.

Since a change amount of the charging characteristics caused by the temperature is several times larger than a change amount caused by the humidity, it is possible to control the charging stably without exerting any influence upon the charging potential due to the temperature variation or the humidity variation, by switching the compensation for the detected temperature per each humidity area.

Figure 2:
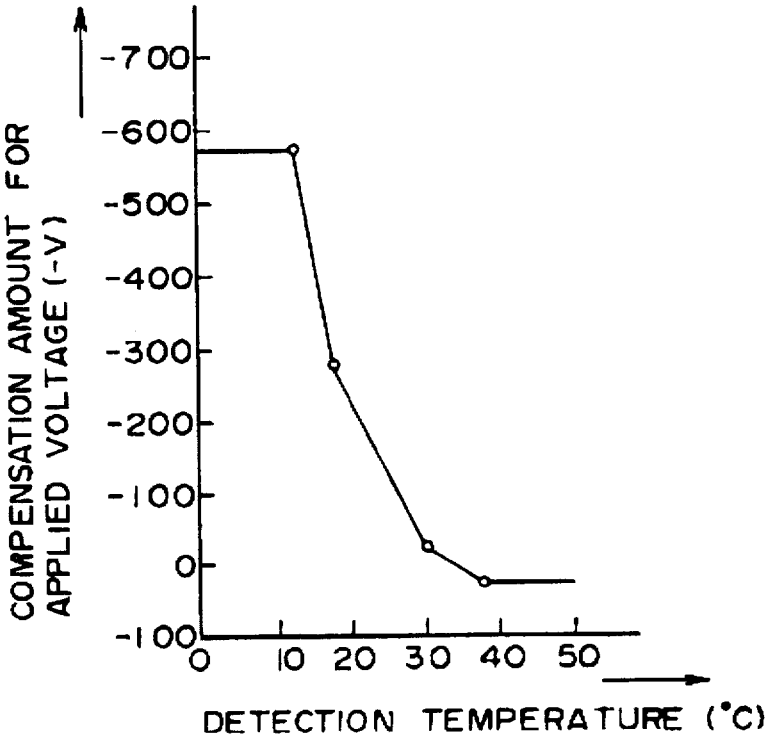
FIG. 2 is a graph showing a relationship between the compensation amount for an applied voltage versus detection temperature.

In this embodiment, a voltage applied to the charging roller 11 is compensated based on a rule shown in FIG. 2 in accordance with the temperature detected by a charging roller temperature detection device 13.

Figure 4:
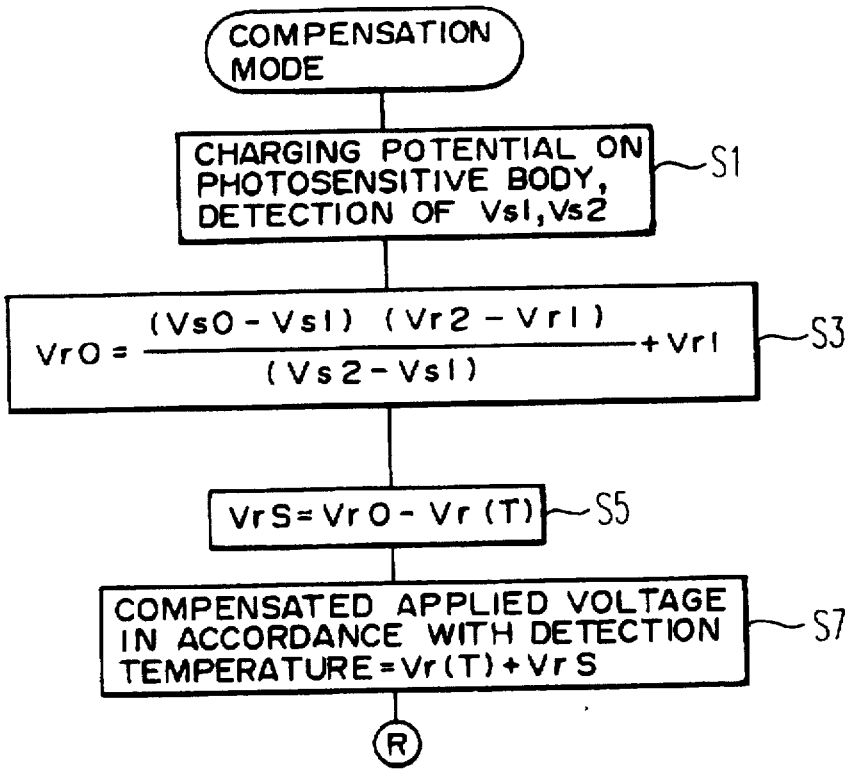
FIG. 4 is a flow chart showing an algorithm for compensating the aberration of charging potential due to humidity variation.

When operating in a compensation mode, with reference to the flowchart of FIG. 4, in step S1 charging potentials Vs1 and Vs2 are detected on the photosensitive body corresponding to applied voltages Vr1 and Vr2 (−1,000 V and −1,500 V, respectively, in this embodiment) are determined at different two points previously determined by a photosensitive body potential sensor 14 disposed in a lower stream from the charging roller 11 in a rotating direction of the photosensitive body 12.

Figure 3:
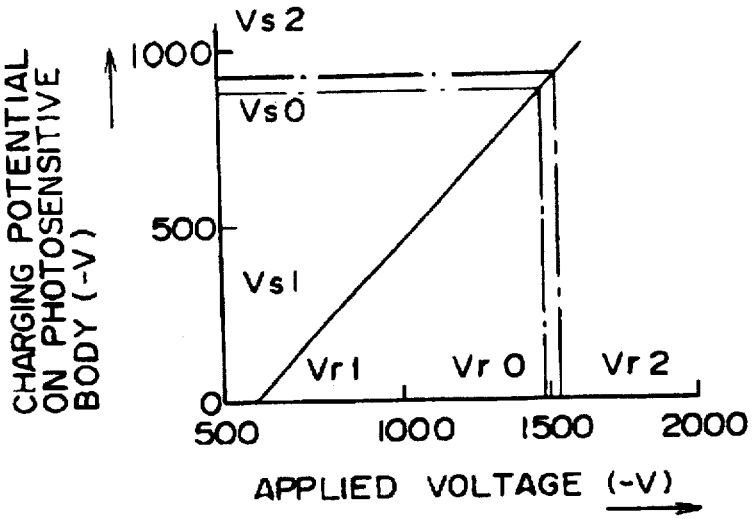
FIG. 3 is a graph showing a relationship between the charging potential on a photosensitive body versus the applied voltage.

Since an applied voltage Vr0 required for making a charging potential equal to a target potential Vs0 (−900 V, in this embodiment) has a relationship between the photosensitive body charging potentials Vs1, Vs2 and the applied voltages Vr1, Vr2 as shown in FIG. 3, the applied voltage Vr0 is obtained, in step S3, by the following equation:

$$Vr0 = \frac{(Vs0 - Vs1)(Vr2 - Vr1)}{(Vs2 - Vs1)} + Vr1 \quad \text{[Equation 1]}$$

In this embodiment, an error (deviation) of the charging potential caused by a humidity variation is compensated by obtaining, in step S5, a difference VrS between an applied voltage Vr(T) compensated by a charging roller detection temperature T at that time and Vr0, and by performing the charging operation in the compensation mode and thereafter with the applied voltage obtained by adding in step S7 the difference VrS to the above applied voltage thus compensated.

Figure 5:
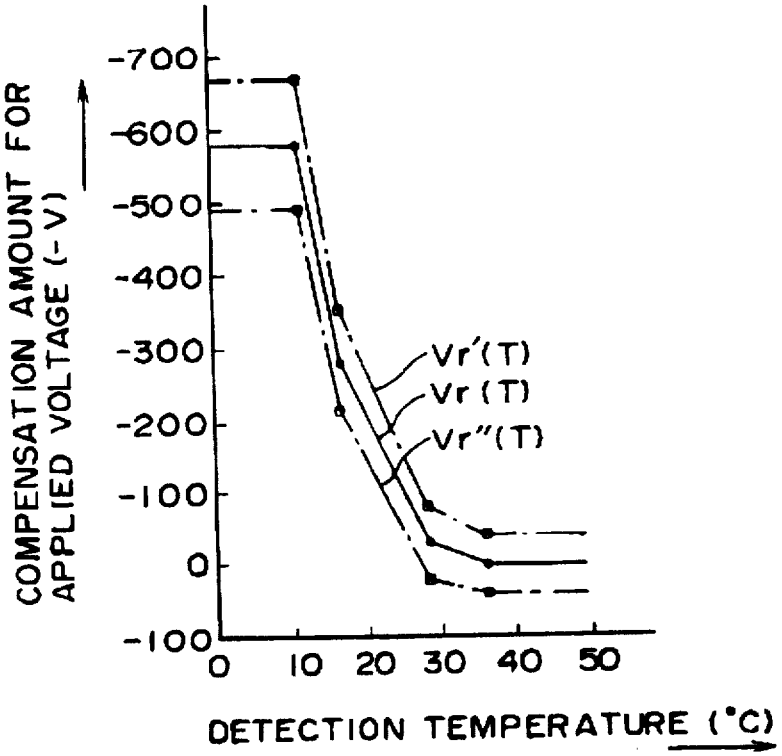
FIG. 5 is a graph showing a relationship between a compensation amount for the applied voltage versus detection temperature.

In addition, as shown in FIG. 5, the charging potential can be controlled more accurately by selecting a compensation rule according to the difference VrS out of a plurality of compensation rules in accordance with a plurality of humidity regions which have been prepared and then compensating the applied voltage based on the selected rule to execute the subsequent charging.

Figure 6A:
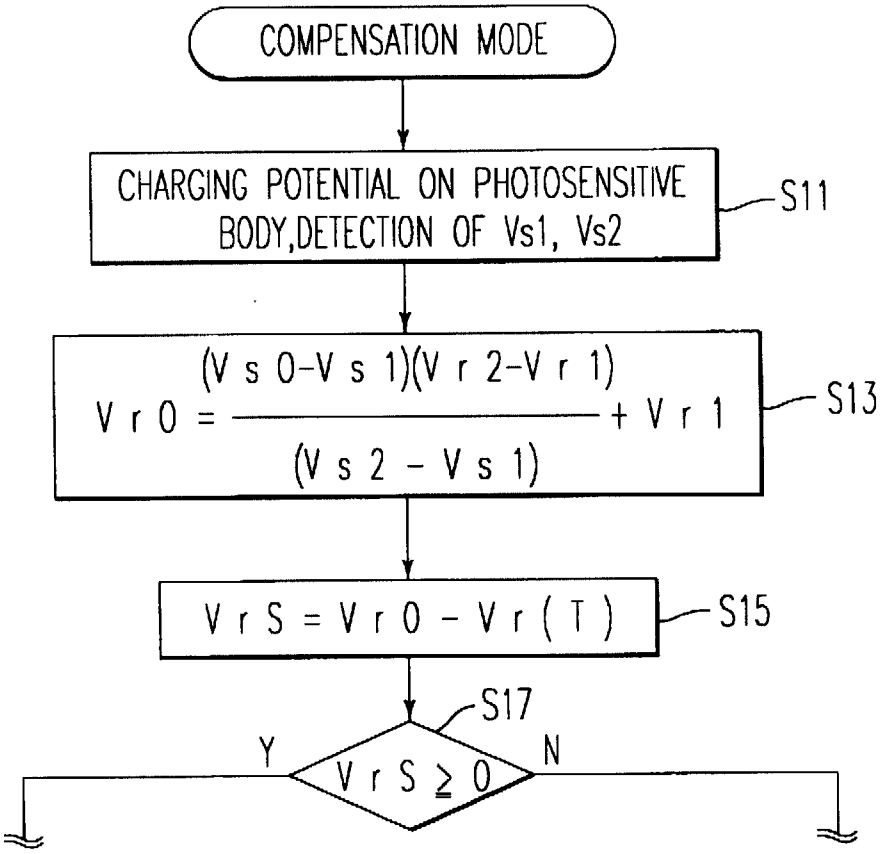
FIG. 6 is a flow chart showing an algorithm for compensating the aberration of the charging potential in humidity areas.
Figure 6B:
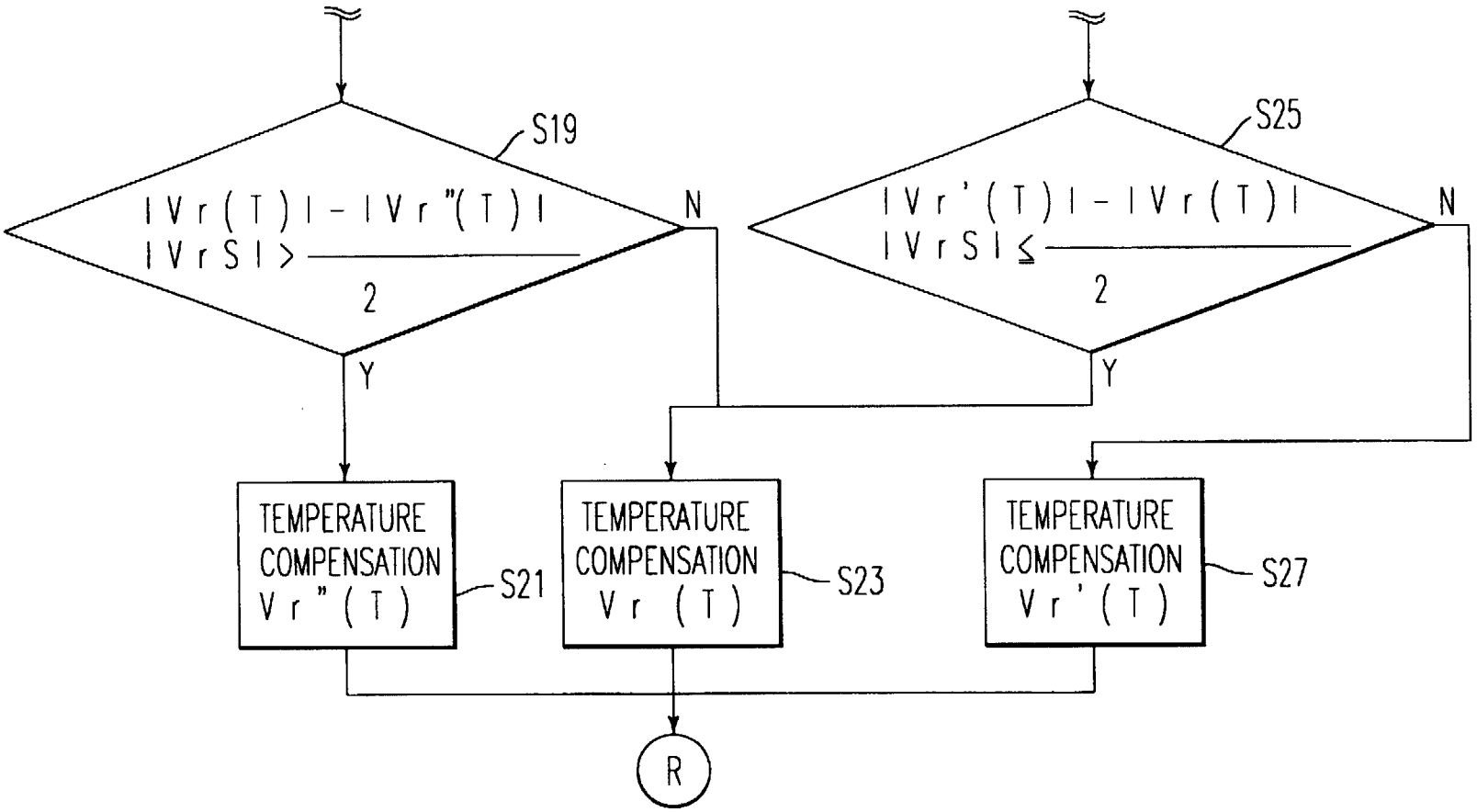

The process for performing the above procedures is shown with reference to FIG. 6. The process begins in step S11 where Vs1 and Vs2 are detected on the photosensitive body 12. The process proceeds to step S13 where equation 1 (as set forth above) is calculated to obtain Vr0. The process then proceeds to step S15 where VrS is calculated as was done in step S5 in FIG. 4. The process then proceeds to step S17 which inquires whether VrS is greater than or equal to 0. If the answer is affirmative, the process flows to step S19 where it is determined if the absolute value of VrS is greater than one-half of the difference between an absolute value of Vr(T) and Vr"(T). If the result of inquiry in step S21 is affirmative, the temperature is compensated with Vr"(T), but if the result is negative, the temperature is compensated with Vr(T). If the result in step S17 is negative, the process flows to step S25 where it is determined if the absolute value of VrS is less than or equal to one-half of the difference between Vr'(T) and Vr(T). If the result of the inquiry in step S25 is affirmative, the process flows to step S23 where the temperature is compensated with Vr(T). However, if the result in step S25 is negative, the process flows to step S27 where the temperature is compensated with Vr'(T).

[Second Embodiment]

Figure 10:
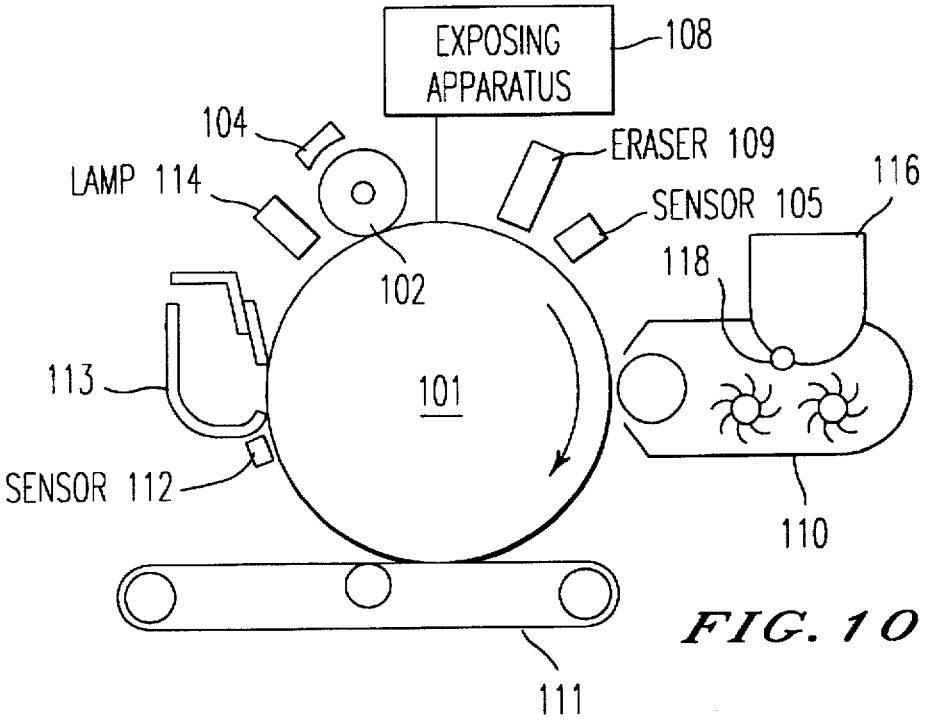
FIG. 10 is a block diagram showing an outline of a main part of an image forming mechanism of the second embodiment according to the present invention.

FIG. 10 shows a main portion of an image forming mechanism of a second embodiment according to the present invention. A drum-shaped photosensitive body 101 has a conductor substrate layer made of aluminum or the like and an optical conductor layer formed on its outer peripheral surface as a basic construction layer. A charging roller 102 is brought into contact with, and charges a surface of, the photosensitive body so to charge the photosensitive body 101 to a predetermined polarity and potential.

Figure 11:
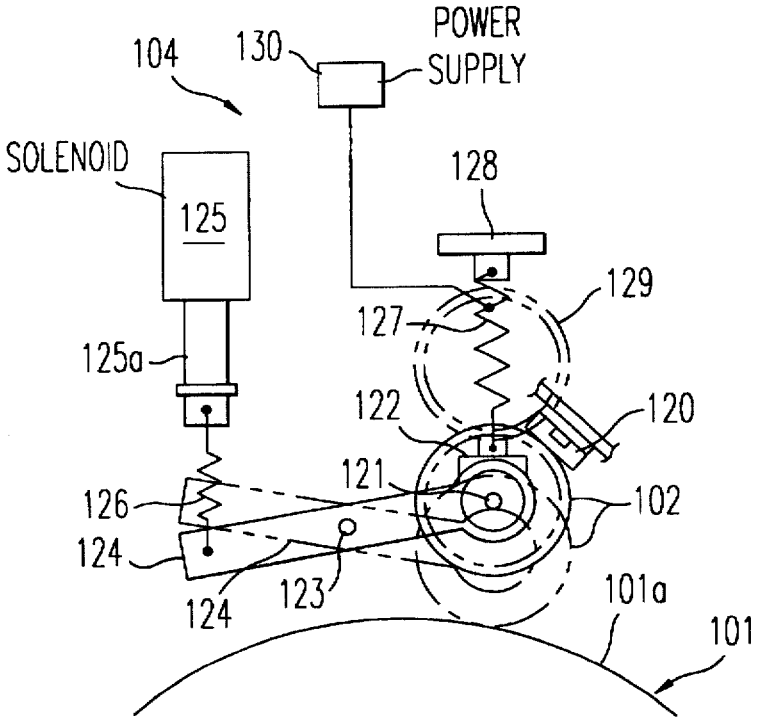
FIG. 11 is an enlarged side view showing a support structure for a charging roller according to the second embodiment.

FIG. 11 shows a supporting structure for the charging roller 102. The charging roller 102 includes a core metal, a conductive layer formed on its outer peripheral surface, and a resistive layer formed on its further outer peripheral surface. Two axes 121 arranged at both ends of the core metal are supported so as to rotate freely at each of an arm 124 and two bearing blocks 122 are in parallel with a photosensitive body 101. Each of the bearing blocks 122 is guided so as to reciprocate freely in a radial direction of the photosensitive body 101 to end plates (not shown) at both ends of the supporting frame 128 and pulled by (two) tensile coil springs 127 in a direction that it is separated from the photosensitive body 101. The arm 124 is permitted to rotate freely around an axis 123. The arm 124 is connected to an end of a tensile coil spring 126 and the other end of the spring 126 is connected to a rod 125*a* of a contact/separation driving solenoid 125.

When the solenoid 125 is energized, the rod 125*a* is pulled upward and the arm 124 rotates in a clockwise direction, so that the charging roller 102 is brought into contact with the photosensitive body 101 (shown by two-dots-and-dash line). It is a position of application for charging the photosensitive body 101. A contact pressure corresponds to a difference of a tension between tensile coil springs 126 and 127. Once the solenoid 125 ceases to be energized, the arm 124 rotates in a counterclockwise direction and the charging roller 102 is separated from the photosensitive body 101 so as to be brought into contact with a cleaning pad 120 (escape position). A gear, which is firmly fixed on the core metal of the charging roller 102, is engaged with a driving gear 129 at the escape position. When the driving gear 129 rotates, the charging roller 102 also rotates and its surface rubs against a pad 120, so that toner (dirt) on the surface thereof is wiped out by the pad 120.

When the charging roller 102 is in contact with the photosensitive body 101 by energizing the solenoid 125 (position indicated by two-dots-and-dash lines in FIG. 11), the charging roller 102 rotates following a rotation of the photosensitive body 101. When the charging power supply circuit 130 (FIG. 11) applies a charging voltage to the core metal (121) through the tensile coil spring 127 and a bearing block 122, the peripheral surface of the photosensitive body 101 is uniformly charged.

Referring again to FIG. 10, an exposing apparatus 108 exposes the surface of the photosensitive body charged by the charging roller 102 with an image light, and thereby an electrostatic latent image is formed thereon. For an exposure of areas other than the area to be transferred to a transfer paper (image area) on the surface of the photosensitive body, an eraser (light emitting element group) 109 is used, which makes a potential at a toner-unattached level. Toner is applied to the electrostatic latent image in the image area by a developer 110, which makes a toner image (visible image) appear on the electrostatic latent image. In the fourth embodiment, the exposing apparatus 108 lights a manuscript document on a manuscript document stand (contact glass) with an exposing lamp to project a reflection light from the manuscript document to the photosensitive body 101 through a mirror and a lens.

The above toner image formed on the photosensitive body 101 is transferred to a transfer paper which is fed onto a transfer belt 111 so as to be synchronized with a movement of the toner image. In other words, a potential for absorbing toner onto the transfer paper is applied to a rear side of the transfer belt 111 and thereby the toner image is transferred to the transfer paper. The surface of the photosensitive body after the transfer operation is wiped out by a cleaning blade of a cleaning apparatus 113, which removes toner remaining on the surface of the photosensitive body. Further, charges on the surface of the photosensitive body are removed by receiving a light irradiation from a charge removing lamp 114 and it is shifted to the charging roller 102.

Between the charging roller 102 and the developer 110, a surface potential sensor 105 detects a surface potential Vch after charging the photosensitive 101. A P sensor 112 detects a toner density on the surface of the photosensitive body 101. These sensors are used in controlling a charging potential, a toner density, or a voltage of the exposing lamp, all described later.

When the charging roller 102 completes a charging process (applying a voltage for charging) for forming an image, the roller is separated from the photosensitive body 101 due to interruption of energizing the solenoid 125 in the contact/separation mechanism 104 in FIG. 11 and returns to the escape position shown by a solid line in FIG. 11. Then, when it remains in the escape position and predetermined cleaning start conditions are satisfied, the driving gear 129 is driven to rotate, the charging roller 102 rotates, and a surface of the roller is cleaned by the pad 120.

Figure 12:
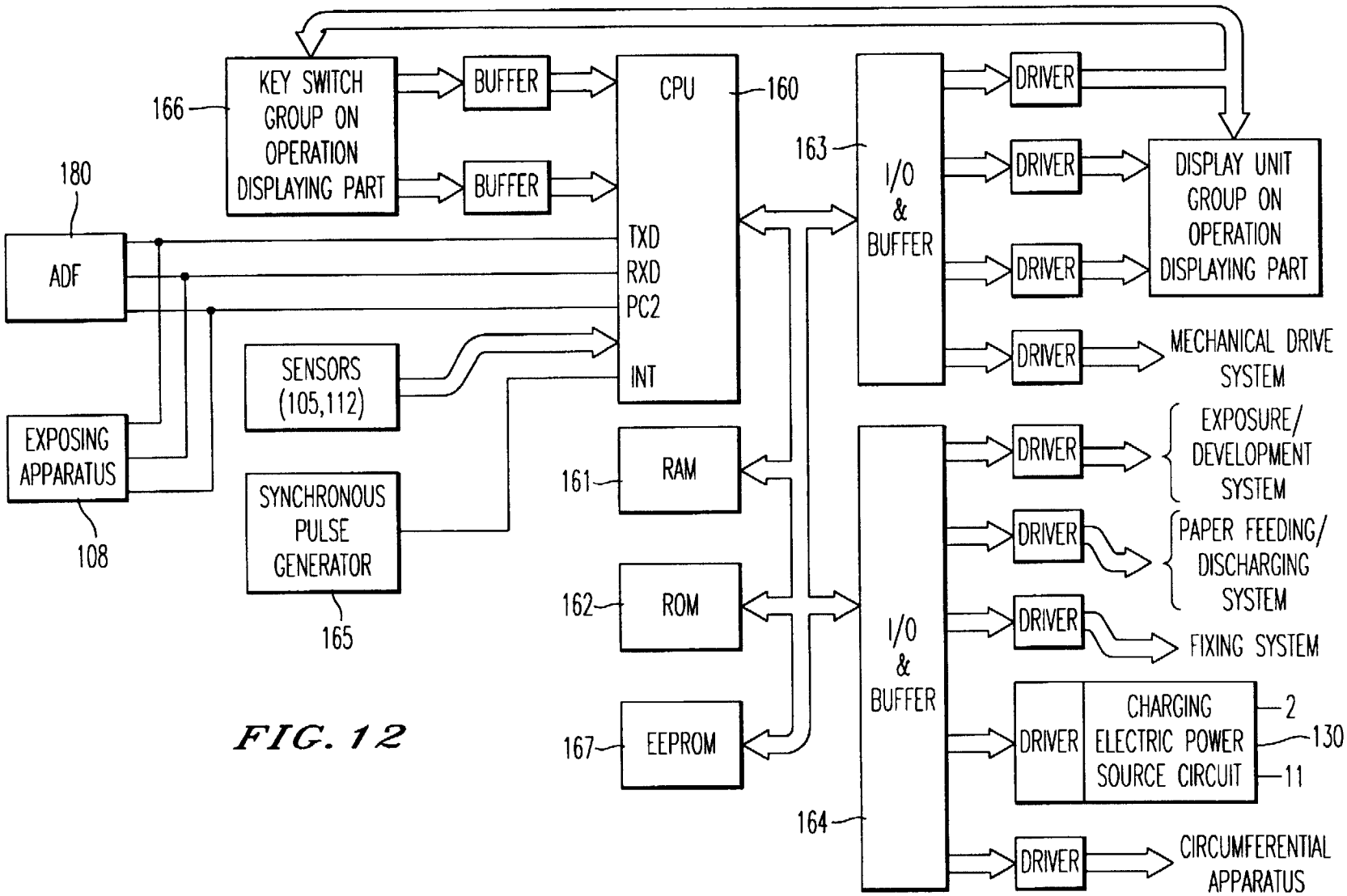
FIG. 12 is a block diagram of an electric circuit system for controlling the operation of the image forming mechanism according to the second embodiment.

FIG. 12 outlines a configuration of a control system of the image forming mechanism of FIG. 10. First, there is provided a control section having a microcomputer which comprises a CPU 160, a RAM 161, a ROM 162, an EEPROM 167 (a nonvolatile storage), and input/output port buffer amplifiers 163 and 164, and the control section controls an automatic document feeder (ADF) 180 and the exposing apparatus 108 by performing serial communication between a TXD, RXD, and PC2 terminals in the CPU 160. In this serial communication, the ADF 180 communicates with the above control section when the output of the PC2 is at a "High" level, while the exposing apparatus 108 communicates with the control section when the output of PC2 is at "Low" level. A microcomputer (not shown) in the ADF 180 performs paper feeding/discharging processing and detects a jam for the manuscript document, based on data transmitted from the control section of a copying machine. On the other hand, a microcomputer (not shown) of the exposing apparatus 108 controls driving of a scanner or a mirror based on the data transmitted from the control section. The CPU 160 contains a recording paper selecting means, a recording paper reusing means, a defective print preventing means, and conveying restarting means as firmware.

A pulse generator 165 generates a synchronous pulse per rotation through a minute angle in synchronization with a rotation of the photosensitive drum 101, and the above control section controls feeding transfer paper and feeding a manuscript document and performs image forming processing (particularly, a timing control) based on a count value of the pulses generated by the synchronous pulse generator 165. The synchronous pulse is generated by the pulse generator 165 in synchronization with a rotation of the photosensitive drum 101 and then given to the CPU 160. The CPU 160 increments a count of the arriving pulses by executing an interrupt handling process whenever a pulse has arrived, and if the count value matches any count value on a timing table (a table in which a relationship between count values and events are stored) when it is compared with count values on the timing table, the CPU executes an event (ON/OFF of an image forming element) assigned to the count value.

Figure 13:
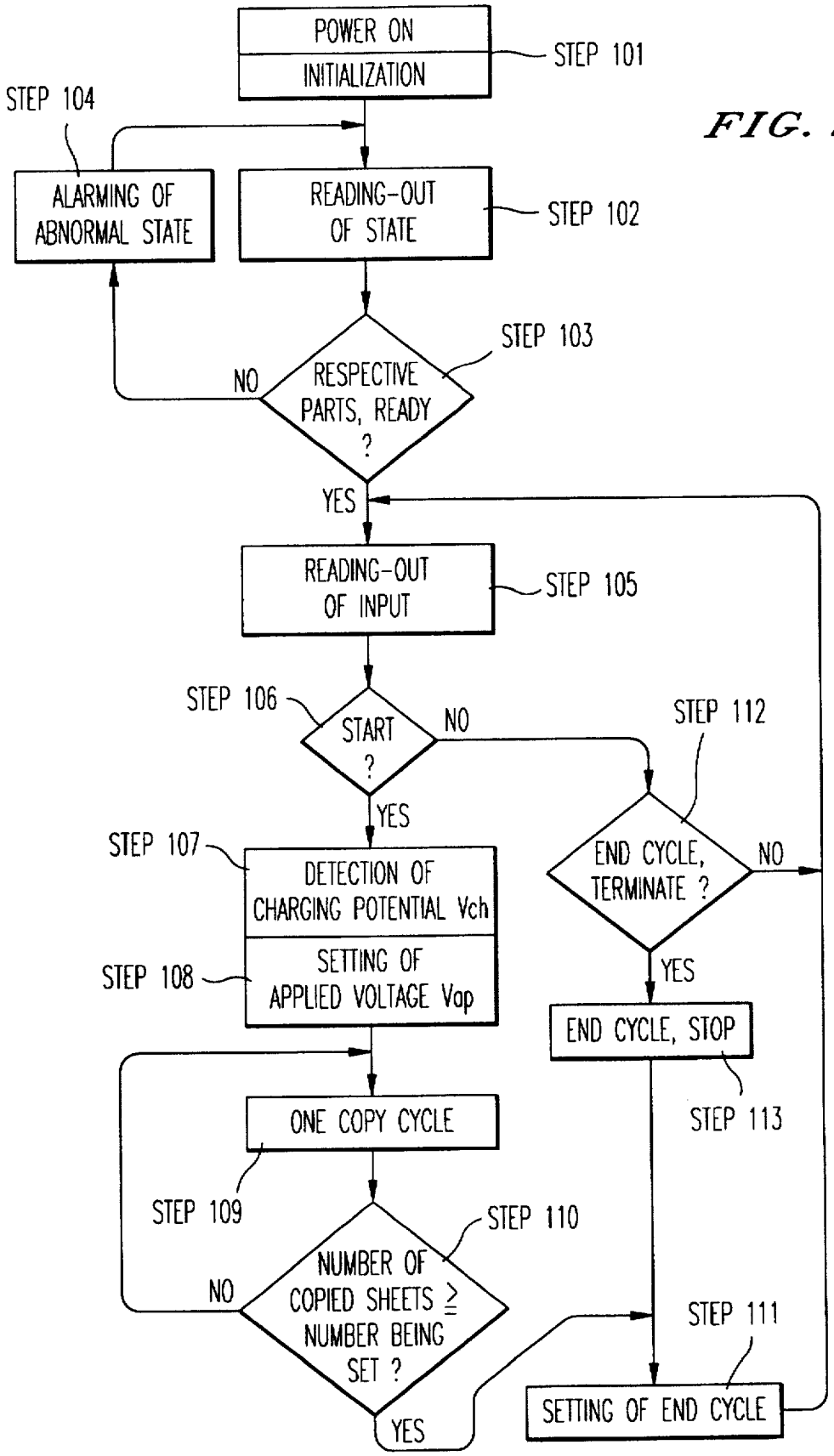
FIG. 13 is a flow chart of the image forming process control flow in the CPU according to the second embodiment.

FIG. 13 outlines a control process performed by the CPU 160. If a power supply is turned on, the CPU 160 sets an internal register, a counter, and a timer to values in a standby state and sets an input/output Ports for a facility (mechanism) unit to signal levels at standby state (Step 101).

After the initialization (Step 101) is finished, the CPU 160 reads a state of the facility unit and checks whether or not an error occurs (a state in which an image cannot be started to be formed) (Steps 102 and 103). If an error is detected, the CPU displays it on an operation board 166 (Step 104). Otherwise, it starts energizing a heater of a fixing apparatus, sets a target temperature to a value at a standby state, starts a warming-up to the target temperature, and then checks whether or not a fixing temperature (a temperature of a fixing roller of the fixing apparatus which is not shown) is set to a standby temperature. If it is not set to the standby temperature, the CPU waits until it is set to the standby temperature. When it is set to the standby temperature, the CPU displays READY (image forming possible) on an operation displaying portion and reads a display of an operator manipulation on the operation board 166, if it is found on the operation board (Step 105). At this time, the CPU writes inputs such as the number of pieces of recorded forms, a recording magnification, and a recording density into a register, if there are any inputs. Hereupon, the register signifies a memory area allocated to the internal memory of the CPU 160 or the RAM 161 or the EEPROM 167.

The process then flows to Step 106, where an inquiry is made whether the process is to start. If so, the process flows to step 107 and the CPU 160 displays the fact on the operation board 166, updates a target temperature of the fixing apparatus 108 to a higher temperature for fixing processing (responding to it, a driver for controlling a fixing temperature switches an energizing current for a fixing heater to a higher level), and then starts driving the rotation of the photosensitive drum 101 and turning on a charge removing lamp (charge removing exposure). Then, predetermined voltages Vap1, Vap2, and Vap3 are applied to the charging roller 102 sequentially each for a fixed time period, and then the values Vch1, Vch2, and Vch3 detected by the surface potential sensor 105 are converted to digital data to be read at a timing when areas on the photosensitive body charged at respective voltages come immediately before the surface potential sensor 105 (Step 107). Next, in Step 108 the CPU 160 obtains a linear equation which represents the relationships among three points, (Vap1, Vch1), (Vap2, Vch2), and (Vap3, Vch3) most accurately. In other words, assuming that this linear equation is Vap=A·Vch+B, coefficients A and B at which differences between the above three points and the linear equation are minimum are obtained in a method of least squares to determine a linear equation, Vap=A·Vch+B which represents the relationships between a voltage Vap applied to the charging roller 102 and a charging potential Vch on the photosensitive body 101 caused by the voltage. After that, data representing the linear expression is saved in the register (Step 108).

Figure 15:
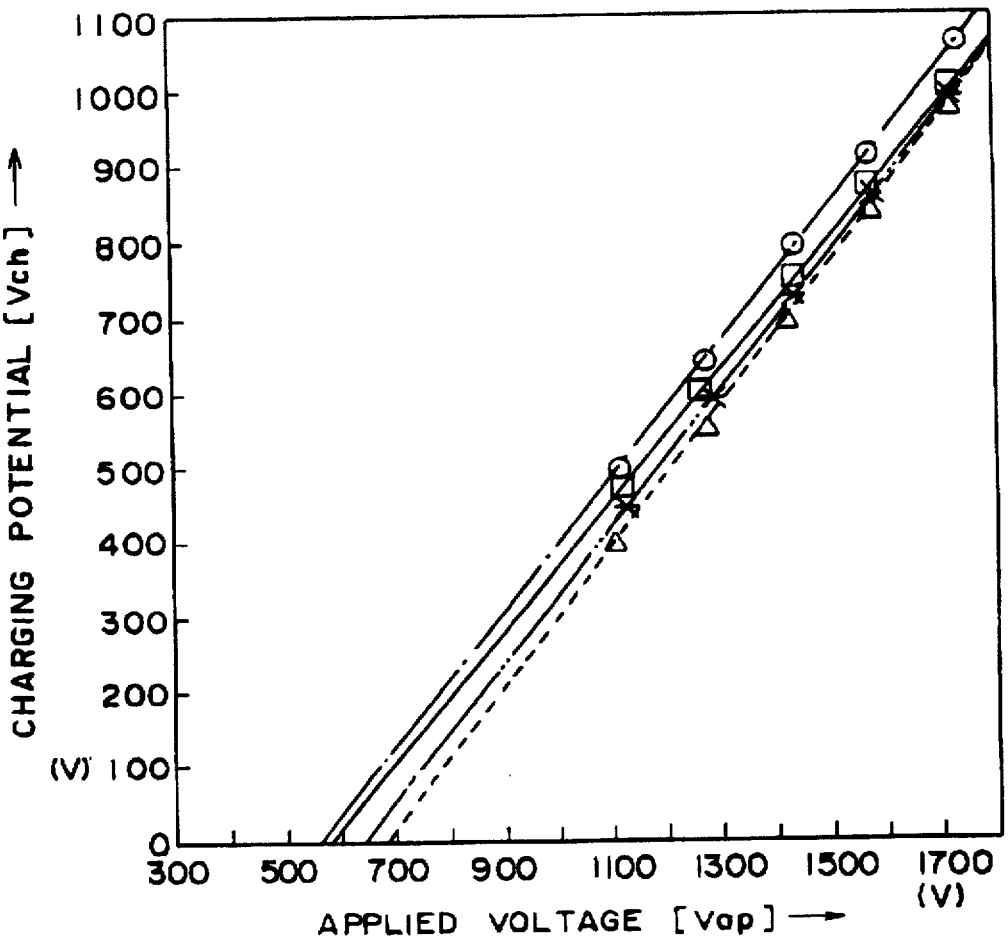
FIG. 15 is a graph showing charging potential of the photosensitive body versus the voltage applied to the charging roller shown of the second embodiment.

FIG. 15 shows a transition of a correlation of a charging potential Vch of a photosensitive body to a voltage Vap applied to the charging roller (characteristics of forming a charging potential) according to an elapsed time (the number of times for forming an image) for using the photosensitive body 101 and the charging roller 102. This correlation is expressed substantially by a straight line. Therefore, as described above, assuming that the correlation is expressed by Vap=A·Vch+B in this embodiment, this straight line is obtained (calculated) based on actually measured values (Vap1, Vch1), (Vap2, Vch2), and (Vap3, Vch3). In other words, characteristics of forming the current charging potential (correlation) are judged (determined) (Step 108).

Referring again to FIG. 13, the CPU 160 in Step 109 sets a start/stop timing of charging, exposing, erasing, feeding, developing, and transferring, etc. for forming an image (recording a piece of an image copy) in the timing table according to an already-entered recording mode. If no recording mode is entered, the "Standard mode" is selected. If no parameter is entered, the "Standard value" is selected. The voltage Vap applied to charging roller 102 is obtained by setting Vap=VapP which is obtained by giving Vch=VchP (target charging potential) to the above determined straight line, and determining Vap=A·Vch+B. Also in Step 109 a single copy cycle (a single image forming processing) is performed to increment a recorded copy counter (register) by one. In this single copy cycle (Step 109), the CPU 160 executes process controls of charging (by using the charging roller 102), exposing, developing, and transferring, and in this charging process by use of the charging roller 102, the above VapP is used for the charging voltage applied to the charging roller 102. In other words, assuming that VapP is a target value of a voltage applied to the charging roller 102 by a charging power supply circuit 130, an output voltage of the power supply circuit is applied to a controlling driver. Monitoring (feeding-back) a voltage applied to the charging roller 102, the driver performs a constant voltage control for the power supply circuit 130 so that the applied voltage matches the target value VapP.

Next, in Step 110, the CPU checks whether or not the number of copied sheets (Number of times that an image is formed: Number of continuous copied sheets) has reached the set copy count. If the number of sheets does not reach the set count, the CPU executes a single copy cycle (Step 109) again. If it reaches the set count, the CPU returns the target temperature of the fixing apparatus to a value at standby state, sets postprocessing (end cycle) such as (continuous time for) cleaning of the photosensitive body, the transfer belt, and the charging roller (Step 111), and awaits the arrival of an input to the operation board 166 (Step 105). If the end cycle terminates without receiving any start input from the operation board 166, the CPU stops the rotation driving of the photosensitive drum 101 and turns off the charging lamp to stop the end cycle (steps 112 and 113). In other words, the facility unit is put into a standby (stop) state.

Figure 14:
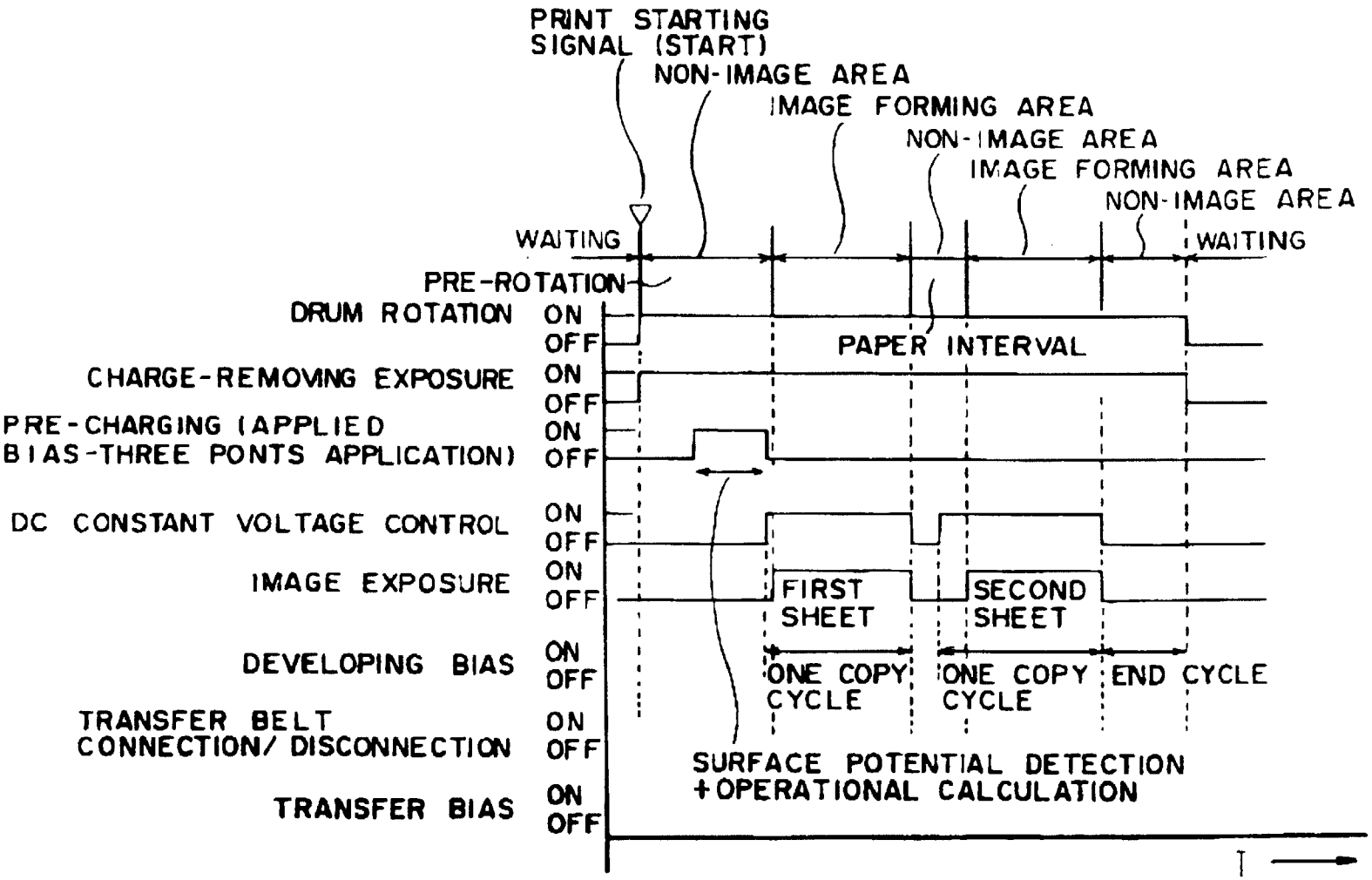
FIG. 14 is a timing diagram showing the operational timing of the image forming mechanism according to the second embodiment.

FIG. 14 shows a timing diagram of elements related to image forming during the time period from a start input to termination of an end cycle (Steps 106 to 113) in the above. This drawing shows the case of performing an operation for two copied sheets specified. In this operation, a pre-rotation period is started by starting a rotation of the photosensitive body 101 of an apparatus which has been put in a standby state on the basis of a print starting signal (start input). The charge removing lamp 114 is turned on at the same time when the rotation of the photosensitive body 101 is started, and charges are removed on one peripheral surface or wider range of the photosensitive body 101. Next, three predetermined voltages Vap1, Vap2, and Vap3 are applied to the respective predetermined-wide areas on the charging roller 102 sequentially. A surface potential sensor 105 detects the surface potentials Vch1, Vch2, and Vch3 of the photosensitive body at the time of applying the respective voltages. The relationships between the applied voltages Vap1, Vap2, and Vap3 and the charging potentials Vch1, Vch2, and Vch3 are recurred to a straight line by the CPU 160 to obtain a correlation of the charging potential Vch to the applied voltage Vap. An applied voltage VapP at the time of the subsequent image forming is set based on the correlation.

Printing (image forming) for the first sheet is explained now. The above voltage is applied to the charging roller 102 to charge the photosensitive body 101, the exposing apparatus 108 exposes a charged surface with an image light to form a electrostatic latent image thereon, the image is developed by the developing apparatus 110, transferred to a transfer material through a transfer process, and thereafter fixed by the fixing apparatus which is not shown, and then the sheet is output. In the same manner as for continuous printing, the applied voltage at the time of forming the respective images is controlled to the above VapP constantly.

In the above configuration and the operations thereof, even if a resistance of the charging roller 102 as a charging member changes due to the effects of environmental conditions (for example, humidity or the like), the above detected potentials Vch1, Vch2, and Vch3 are lowered if the resistance value goes up, and the applied voltage VapP is determined based on the potentials to form an image. Therefore, the charging potential of the photosensitive body 101 is fixed to a target value independently from changes of the resistance values of the charging roller 102.

A film thickness of the photosensitive body 101 may be decreased in some cases since the surface of the photosensitive body 101 is abraded by being rubbed against the cleaning apparatus 113 or a transfer belt 111, and a current which flows through the photosensitive body 101 is increased by a decrease of the film thickness at this elapsed time and it leads to a problem that the charging potential is lowered at the elapsed time when a constant current control is performed. In addition, even if the film thickness does not change, a continuous use of the photosensitive body causes electrostatic fatigue and values of the current flowing through the photosensitive body are different between the states after it has been left for a long time and after it has been continuously used. The above matters lead to a problem that the charging potential depends on a state of the use if a constant current control is performed. This embodiment, however, is effective for solving this problem.

Furthermore, since it is impossible to prevent the resistance value from being uneven at the time of manufacturing the photosensitive body 101 and the charging roller 102, an applied voltage must be adjusted to obtain an optimum surface potential for each machine. This problem can be also solved by executing this embodiment in which the voltage can be easily adjusted.

[Third embodiment]

Figure 16:
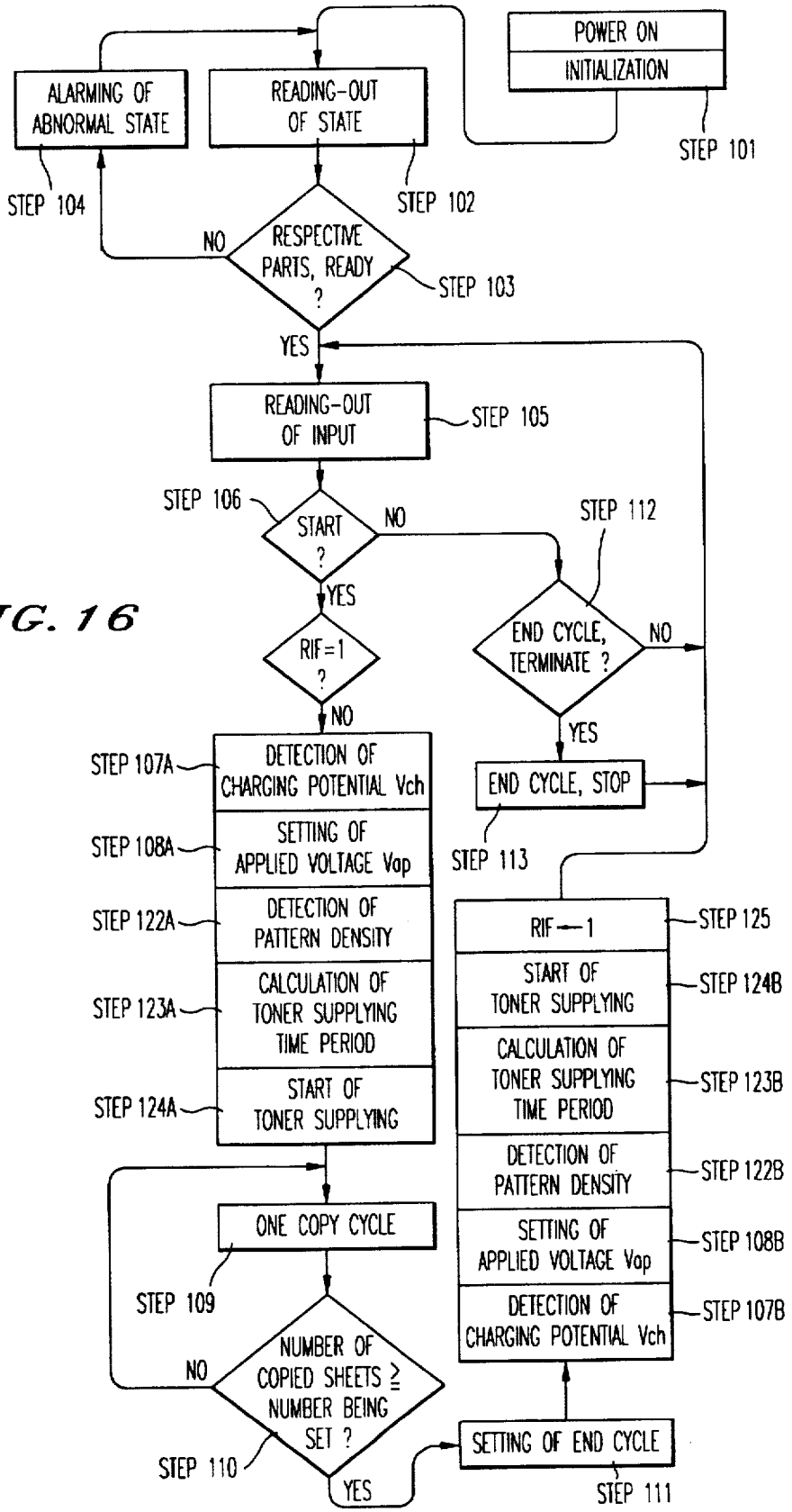
FIG. 16 is a flow chart showing of the image forming control process performed in the CPU of a third embodiment according to the present invention.

Although a hardware configuration of a third embodiment is the same as for the second embodiment in the above, a part of the image forming control of the CPU 160 is not identical. FIG. 16 shows an outline of a control operation of the CPU 160 in the third embodiment. For steps whose processing is the same that shown in FIG. 13, the same step number of FIG. 13 are used for FIG. 16. In this third embodiment, the CPU 160 applies three voltages Vap1, Vap2, and Vap3 predetermined at the three points to a charging roller 102 sequentially for respective time periods responding to the first start input after the power supply is turned on in the same manner as that of the second embodiment (FIG. 13), and then converts the detection values, Vch1, Vch2, and Vch3 detected by the surface potential sensor 105 to digital data to be read, at a timing when areas of the photosensitive body charged at respective voltages come immediately before the surface potential sensor 105 (Step 107A). Then, a linear equation Vap=A·Vch+B is determined, which represents a relationship between a voltage Vap applied to the charging roller 102 and a charging potential Vch generated by the voltage on the photosensitive body 101 (Step 106A).

Next, in step 122A a target applied voltage Vap=VapP is calculated by giving Vch=VchP (target charging potential) to the determined linear equation Vap=A·Vch+B, the photosensitive body 101 is charged by giving the value thus calculated to a driver for controlling an output voltage of a charging power supply circuit 130 to a constant voltage as a target value, and an optical pattern (exposed/unexposed pattern) for detecting a toner density is projected on the charging surface to detect toner densities (Vsg for an exposed area, Vsp for unexposed area) of areas (an exposed area and an unexposed area) developed by the developing apparatus 110 by use of a P sensor 112. Next, after calculating a toner supplying amount (a rotational driving time for a toner supplying roller 118) corresponding to a ratio Vap/Vsg of the toner density Vsp for the unexposed area (a black written area) to the toner density vsg for the exposed area (a background area) (Step 123A) if the value exceeds zero, the CPU starts the rotational driving of the toner supplying roller 118 and measurement of the elapsed time (Step 124A). If the elapsed time has reached the above calculated driving time, the CPU stops the rotational driving of the toner supplying roller 118.

After that, a single copy cycle is repeated (Steps 109, 110) until the number of copied sheets reaches a set copy count in the same manner as that of the above second embodiment and processing proceeds to an end cycle. In the third embodiment, however, when the end cycle is set, the CPU 160 executes again the same processing as the above "detecting the charging potential Vch" (Step 107A), "setting applied voltage Vap" (Step 108A), "detecting a pattern density" (Step 122A), "calculating a toner supplying time" (Step 123A), and "starting toner supplying" (step 124A) in the same manner (Steps 107B, 108B, 122B, 123B, and 124B). Then, the CPU writes data, "1: a charging voltage is set and the toner density is adjusted immediately after the termination of the copy." Other processing is the same as that of the above second embodiment. When any start input is given next without turning off the power supply of the apparatus, the above Steps 107A, 108A, 122A, 123A, and 124A such as "detecting a charging potential Vch" immediately after the above start input are not executed since the data in a register RIF are indicated by 1, and the Steps 107A, 108A, 122A, 123A, and 124A such as "detecting a charging potential Vch" are executed immediately after the termination of the set copy count.

Figure 17:
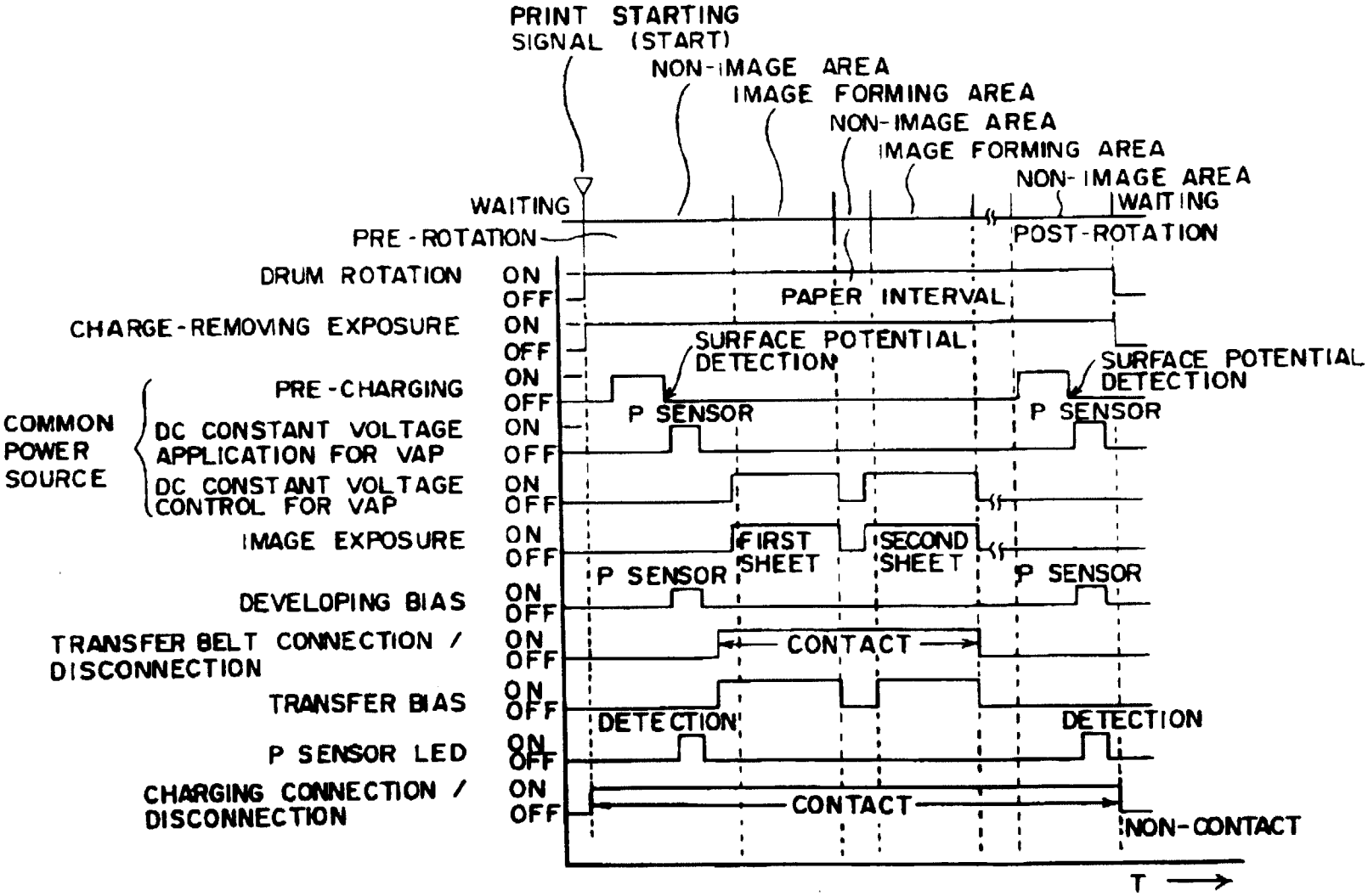
FIG. 17 is a timing diagram showing the operational timing of the image forming mechanism under the control of the CPU of the third embodiment.

FIG. 17 shows an operation timing of elements related to image forming from a start input immediately after turning on the power supply to a termination of an end cycle (Steps 106 to 113) of the third embodiment. It is intended for 2 sheets to be specified as the number of copied sheets. A pre-rotation period is started by a rotation of the photosensitive body 101 based on the first print start signal (start input) after the power supply is turned on. At the same time when the rotation of the photosensitive body 101 is started, the charge removing lamp 114 is turned on and charges on the photosensitive body 101 are removed by one peripheral surface or wider range. Next, a relationship between an applied voltage Vap and a charging potential Vch generated by the voltage is detected. After a charging voltage Vap calculated based on this relationship is applied to the charging roller 102 to charge the surface of the photosensitive body 101, charges are removed by an eraser 109 for areas other than a range of 65 mm×35 mm read by a P sensor 112, in other words, a toner pattern area, and then developing is performed for the toner pattern area at a certain bias Vbp by a developing apparatus 110. In this processing, a transfer belt 111 is separated from the surface of the photosensitive body 101, and the toner pattern is read by the P sensor 112 in a state of being formed on the surface of the photosensitive body. Hereinafter, a potential of the pattern area formed at this time is called Vsp. Furthermore, a potential of the erased area around the toner patterns, in other words, the background area (hereinafter, called Vsg) is detected by the P sensor 112. After detecting the potentials Vsp and Vsg, the toner patterns on the photosensitive body are removed from the surface of the photosensitive body by a cleaning apparatus 113. Thereafter, a normal image forming operation is started through an exposure and charge removing with the charge removing lamp 114. In other words, the charging voltage VapP is applied to the charging roller 102 to charge the surface of the photosensitive body 101, an image on the manuscript document is exposed by the exposing apparatus 108, an electrostatic latent image is formed on the surface of the photosensitive body 101 and developed by the developing apparatus 110, a toner image (a picture image) is transferred to a transfer paper through transfer processing, and the toner image is fixed to the transfer paper by a fixing apparatus to take off the paper outside the machine.

In accordance with a density detection value (potential of toner pattern are a/potential of background area=Vsp/Vsg) detected by the P sensor 112, toner is supplied to the developing apparatus 110 and the operation of the toner supplying roller 118 is controlled. In other words, a toner density in the developing apparatus 110 is controlled by driving rotation of the toner supplying roller 118 for supplying toner from a toner hopper 116 to the developing apparatus 110 and controlling its rotation time. Thereby, a density of an image is controlled.

According to the third embodiment, the environmental changes or deterioration of sensitivity of the photosensitive body do not cause any potential changes in the toner pattern area for detecting a toner density. Therefore, the toner density can be always detected accurately so as to achieve an appropriate toner density control.

[Fourth embodiment]

Figure 18:
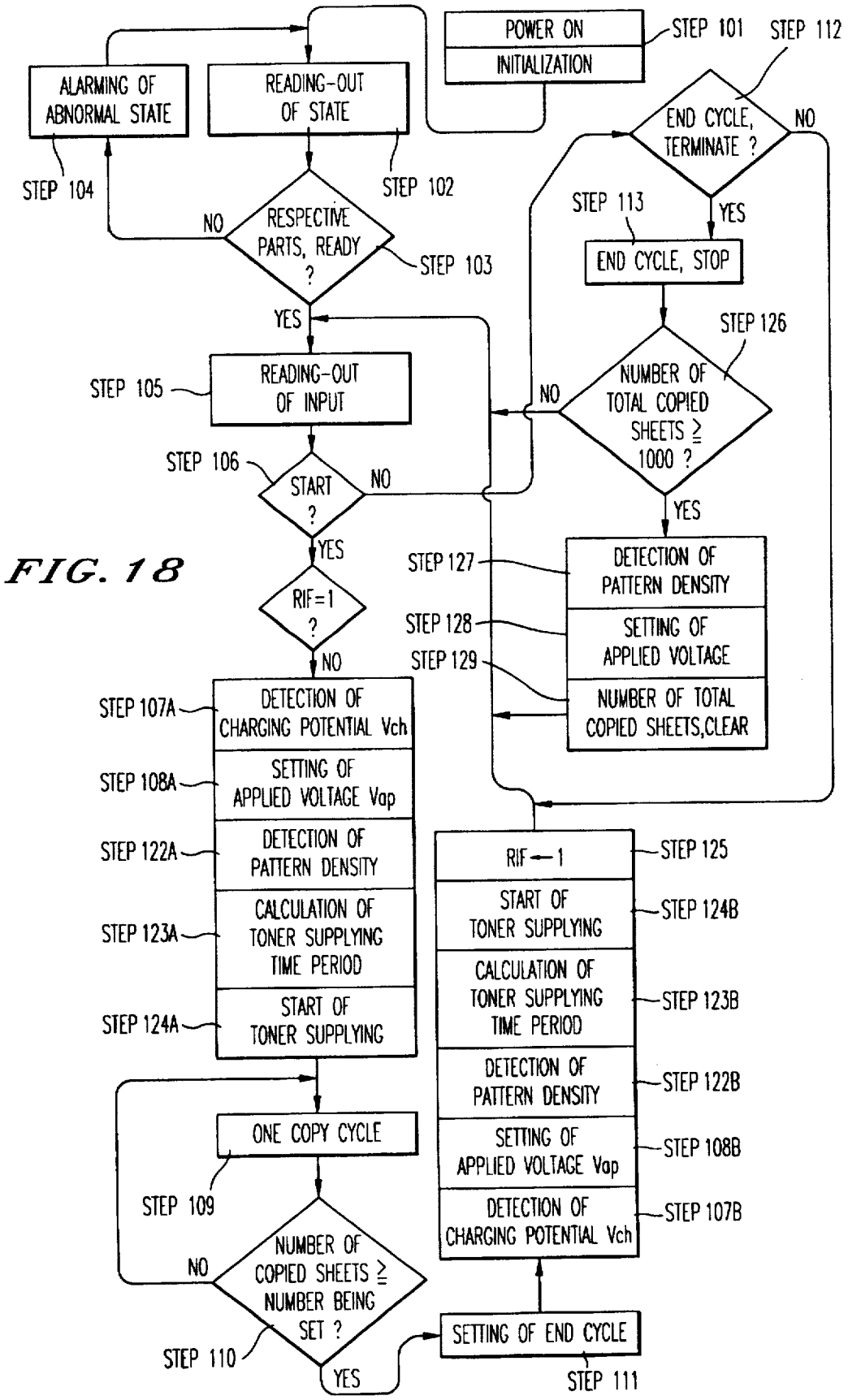
FIG. 18 is a flow chart showing of the image forming control process performed in the CPU of a fourth embodiment according to the present invention.

Although a hardware configuration of a fourth embodiment is the same as that of the second embodiment in the above, a part of the image forming control of the CPU 160 is not identical. FIG. 18 shows an outline of a control operation of the CPU 160 in the fourth embodiment. In the fourth embodiment, the CPU 160 executes the above "detecting the charging potential Vch" (Step 107A), "setting applied voltage Vap" (Step 108A), "detecting a pattern density" (Step 122A), "calculating a toner supplying" (Step 123A), and "starting toner supplying" (Step 124A) when the first start input is detected after the power supply is turned on in the same manner as that of the third embodiment (FIG. 16), and thereafter, executes the same processing in the same manner whenever copying by the set count is completed while the power supply is turned on (Steps 107B, 108B, 122B, 123B, and 124B).

In addition, in the fourth embodiment, the CPU checks whether or not the copy count accumulated value written in a register allocated to a nonvolatile memory has reached 1,000 (Step 126) after a termination of an end cycle. If it has reached 1,000, the CPU applies a charging voltage VapP to the charging roller 102 to adjust a voltage of an exposing lamp, exposes a standard density pattern of a low density on a charged surface of a photosensitive body, and detects a toner density (Vlg for exposed area, Vlp for unexposed area) of the areas developed by a developing apparatus 110 (exposed area and unexposed area) of the pattern by using a P sensor 112 (Step 127). Next, the CPU calculates a voltage Vep of the exposing lamp corresponding to a ratio VLp/VLg of a toner density VLp of the unexposed area (a black written area at a low density) to a toner density VLg of the exposed area (a background area) and writes it in the register allocated to the nonvolatile storage (Step 128). Then, the copy count accumulated value is cleared (initialized to 0) (Step 129). Voltage Vep is given as a target value to a driver for applying a voltage to the exposing lamp of an exposing apparatus 108, and the driver performs the constant voltage control for the voltage applied to the exposing lamp so that the voltage of the exposing lamp matches the target value Vep.

FIG. 19 shows an operation timing of elements related to image forming for a period of setting the voltage Vep of the exposing lamp as mentioned above (Steps 127 and 128). After the charging voltage VapP is applied to the charging roller 102 to charge the surface of the photosensitive body 101, a latent image is formed on the photosensitive body 101 and developed at a certain constant bias Vb by the developing apparatus 110 by using a background potential detected pattern disposed in the rear side of the forward portion of an optical frame as an original image. At this time, a transfer belt 111 is separated from the surface of the photosensitive body 101, and a toner pattern of the background potential detected pattern is read by the P sensor 112 with being formed on the surface of the photosensitive body 101. Hereinafter, the potential of the pattern area is called VLp. In addition, the P sensor 112 detects a potential (VLg) of the erased area around the toner pattern, in other words, the background area, and calculates a voltage Vep of the exposing lamp based on a ratio of the above VLp and VLb values, that is, a density detected value. After detecting the VLp and VLg, the toner pattern on the photosensitive body is removed from the surface of the photosensitive body by a cleaning apparatus 113.

In the fourth embodiment, the exposing lamp voltage Vep and the density ratio VLp/VLg are set respectively to the standard values after cleaning an optical system or after replacing the photosensitive body 101 by the other, and thereafter an actual density ratio VLp/VLg is detected at fixed intervals at the above exposing lamp voltage to compensate the lamp voltage based on a ratio of the detected value to the standard value.

According to the third embodiment, any environmental changes do not cause any potential changes in the toner pattern area for detecting the intensity of the exposure. Therefore, a toner pattern can be always generated accurately so as to achieve an appropriate exposure amount control.

In the third and fourth embodiments in the above, although the linear equation Vap=A·Vch+B, which represents a relationship between the voltage Vap applied to the charging roller 102 and the charging potential Vch generated on the photosensitive body 101 by the voltage, is determined based on three measurement values, it is also possible to determine the equation based on two or four or more measurement values. If it is determined based on two measurement values, an effect of a measurement error is relatively large. With three measurement values, however, the effect is relatively small. While the effect of the measurement error is decreased by increasing the number of the measurement values, the calculation for determining the linear equation becomes more complicated and time-consuming.

As is apparent from the foregoing descriptions of the embodiments according to the present invention, some merits or advantageous functional effects can be found out.

In the contact-type charging apparatus of the embodiment according to the present invention in which the temperature is detected and thereby the applied voltage is compensated, the applied voltage needed for making the charging potential equal to a target potential is obtained by detecting the charging potential, and then the compensation rule for the detected temperature is further compensated in accordance with the value (the value of the applied voltage thus obtained). In such manner, the charging potential can be stably controlled even though the environmental factors such as temperature, humidity, etc. change.

And further, the difference value between the applied voltage needed for making the charging potential equal to the target potential and the other applied voltage determined by the (detected) temperature is obtained. The charging is done with the applied voltage obtained by adding the above difference value to the applied voltage determined by the temperature. In such manner, it may be possible to control the charging potential simply and stably.

In the contact-type charging apparatus of the other embodiments according to the present invention, the linear equation Vap=A·Vch+B representing the relationship between the voltage Vap applied to the charging roller and the charging potential appearing thereby on the photosensitive body is determined on the basis of the three-points measurement values.

If the number of the measurement points is small (for instance, two points), the influence exerted on the measurement error becomes large. On the other hand, if the number of the measurement is large (more than three), the calculating operation for determining the linear equation becomes complicated and thereby it takes much more times to determine the above linear equation. In the embodiments, the problems as mentioned above can be solved. Namely, the influence exerted on the measurement error can be decreased and the calculating operation for determining the linear equation can be made simple (not complicated) in order to reduce the time needed for determining the above equation.

Furthermore, plural rules of the applied voltage compensation are provided for the detected temperature, and an optimum applied voltage compensating rule is selected in accordance with the above-mentioned difference value. In such manner, it may be possible to control the charging potential further stably.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A charging apparatus comprising:

a charging member disposed to contact a photosensitive body in order to apply a charging potential to said photosensitive body;

a voltage measuring device that measures the charging potential and provides a corresponding measured charging potential signal;

an environmental condition sensor which senses at least one environmental condition proximate said charging member and outputs an environmental condition signal;

an adjustable voltage applicator connected to said charging member and which applies an applied voltage to said charging member; and a controller which receives said environmental condition signal and said charging potential signal and controls an amount of said applied voltage in accordance with said charging potential signal and said environmental condition signal, comprising, a target applied voltage determining mechanism that detects a charging potential on said photosensitive body in response to the applied voltage applied to said charging member and produces an uncompensated target applied voltage that corresponds with a target charging potential, and an environmental condition compensation mechanism that adjusts said uncompensated target applied voltage based on said environmental condition signal and provides a compensated target applied voltage that more closely corresponds with said target charging potential, said controller adjusting said adjustable voltage applicator to apply said compensated applied voltage to said charging member.

2. The charging apparatus of claim 1, wherein:

said environmental condition sensor comprises a temperature sensor which senses a temperature of said charging member and outputs a corresponding temperature signal, said environmental condition signal comprises said temperature signal; and said environmental compensation mechanism comprises a temperature compensation mechanism that compensates said uncompensated target applied voltage based on temperature according to a compensation rule and said temperature signal.

3. The charging apparatus of claim 1, wherein:

said environmental condition sensor comprises a humidity determining mechanism which determines a humidity proximate said charging member and outputs a corresponding humidity signal, said environmental condition signal comprises said humidity signal; and said environmental compensation mechanism comprises a humidity compensation mechanism that compensates said uncompensated target applied voltage based on humidity according to a compensation rule and said humidity signal.

4. The charging apparatus of claim 2, wherein said environmental compensation mechanism comprises a humidity compensation mechanism that determines a difference voltage between said uncompensated target applied voltage and said compensated target applied voltage and adds said difference voltage to said compensated target applied voltage to provide a temperature-humidity compensated target applied voltage.

5. The charging apparatus of claim 4, wherein said humidity compensation mechanism adjusts said difference voltage by a humidity compensation rule prior to adding said difference voltage to said compensated target applied voltage.

6. The charging apparatus of claim 5, wherein said compensation mechanism is configured to select said humidity compensation rule from among a plurality of humidity compensation rules based upon said temperature signal.

7. The charging apparatus according to claim 2, wherein said compensation mechanism is configured to select said compensation rule from among a plurality of compensation rules based upon said temperature signal.

8. The charging apparatus according to claim 1, wherein said:

environmental condition sensor comprises a deterioration determination mechanism that determines an amount by which a shape of said photosensitive body has changed with respect to a predetermined shape, said environmental condition signal comprises a deterioration signal; and said environmental compensation mechanism of said controller comprises a deterioration compensation mechanism that compensates said uncompensated target applied voltage based on said deterioration signal.

9. The charging apparatus according to claim 1, wherein said charging member is movably disposed so to contact said photosensitive body when in an image forming mode of operation and so not to contact said photosensitive body when in a cleaning mode of operation.

10. An image forming apparatus comprising:

a photosensitive body having a charging surface;

a charging member disposed to contact said photosensitive body in order to charge said charging surface;

an adjustable voltage source which applies an applied voltage to said charging member;

an exposing apparatus that produces a light having an adjustable intensity that exposes an electrostatic latent image on the charging surface of said photosensitive body;

a developer unit which develops said electrostatic latent image to create a visible image;

a surface potential detector that detects a surface potential on said charging surface; and a correlation mechanism that selectively applies at least two voltages to said charging member through said adjustable voltage source and reads corresponding detection values provided by said surface potential detector, said correlation mechanism determines a correlation result between said at least two voltages and said corresponding detection values, said correlation result provided to at least one of said adjustable voltage source, said exposing apparatus and said developer unit so to respectively adjust said applied voltage, adjust said adjustable intensity of said light, and adjust an amount of developer in said developer unit.

11. The image forming apparatus of claim 10, wherein said correlation mechanism adjusts said applied voltage in accordance with said correlation result in order to form a predetermined surface potential on said charging surface of said photosensitive body.

12. The image forming apparatus of claim 10, further comprising:

a pattern forming mechanism which cooperates with said exposing apparatus to form a test electrostatic latent image pattern on said charging surface;

a first developer detector that detects an amount of developer attachment on said electrostatic latent image pattern; and an exposure adjustment mechanism that adjusts said intensity of said light based on said amount of developer attachment detected by said first developer detector so a subsequent amount of developer attachment on a subsequent electrostatic latent image more closely matches a predetermined amount.

13. The image forming apparatus of claim 10, further comprising:

pattern exposing means for applying said applied voltage to form a predetermined surface potential in accordance with said correlation result and for exposing a light ray pattern to test an exposure intensity on said photosensitive body charged with said applied voltage;

developer detecting means for detecting a developer attachment amount developed by said developing means corresponding to said light rays pattern; and a developer adjustment mechanism that adjusts an amount of developer used to develop said electrostatic latent image to correspond with a predetermined image density based on said developer attachment amount detected by said developer detection means.

14. The image forming apparatus of claim 13, further comprising:

light ray pattern exposing means for applying said light of said exposing apparatus to test an exposure intensity in accordance with said correlation result and at a timing sequence that does not interfere with a formation of an image of a manuscript document; and exposure intensity setting means for setting a light intensity of said exposing apparatus in accordance with the detected value of said developer detecting means, said exposing apparatus using said exposure intensity set by said exposure intensity setting means to expose a electrostatic document image of a manuscript document.

15. The image forming apparatus of claim 10, further comprising a cleaning mechanism which cleans said charging member after at least one electrostatic document image has been formed and prior to a second electrostatic document image being formed.

16. The image forming apparatus of claim 10, further comprising:

a voltage measuring device that measures the charging potential on said photosensitive body and provides a measured charging potential signal;

an environmental condition sensor which senses at least one environmental condition proximate said charging member and outputs an environmental condition signal; and a controller which receives said environmental condition signal and said charging potential signal and controls an amount of said applied voltage in accordance with said charging potential signal and said environmental condition signal, comprising, a target applied voltage determining mechanism that detects a charging potential on said photosensitive body in response to a corresponding applied voltage and produces an uncompensated target applied voltage that corresponds with a target charging potential, and an environmental condition compensation mechanism that adjusts said uncompensated target applied voltage based on said environmental condition signal and provides a compensated target applied voltage that more closely corresponds with said target charging potential.

17. A charging apparatus comprising:

a charging member means for applying a charging potential to a photosensitive body;

a voltage measuring means for measuring the charging potential and providing a measured charging potential signal;

an environmental condition sensor means for sensing at least one environmental condition proximate said charging member means and outputting an environmental condition signal;

an adjustable voltage applicator means for applying an applied voltage to said charging member means; and a controlling means for controlling an amount of said applied voltage applied to said charging member means in accordance with said charging potential signal and said environmental condition signal, comprising, a target applied voltage determining means for detecting a charging potential on said photosensitive body in response to the applied voltage applied to said charging member means and for producing an uncompensated target applied voltage that corresponds with a target charging potential, and an environmental condition compensation means for adjusting said uncompensated target applied voltage based on said environmental condition signal and provides a compensated target applied voltage that more closely corresponds with said target charging potential, said for adjusting said adjustable voltage applicator to apply said compensated applied voltage to said charging member means.

18. An image forming apparatus comprising:

a photosensitive body having a charging surface;

a charging member means for charging said charging surface;

an adjustable voltage source means which applies an applied voltage to said charging member means;

an exposing means that produces a light having an adjustable intensity that exposes an electrostatic latent image on the charging surface of said photosensitive body;

a developing means which develops said electrostatic latent image to create a visible image;

a surface potential detecting means for detecting a surface potential on said charging surface; and a correlating means for selectively applying at least two voltages to said charging member means through said adjustable voltage source and for reading corresponding detection values provided by said surface potential detecting means, and for determining a correlation result between said at least two voltages and said corresponding detection values, said correlation result provided to at least one of said adjustable voltage source means, said exposing means and said developing means for respectively adjusting said applied voltage, said adjustable intensity of said light, and an amount of developer in said developer unit.

19. A method for charging a photosensitive body comprising the steps of:

applying an applied voltage to a charging member;

applying a charging potential to a photosensitive body from said charging member;

measuring the charging potential, and providing a corresponding measured charging potential signal;

sensing at least one environmental condition proximate said photosensitive body, and outputting a corresponding environmental condition signal;

controlling an amount of said applied voltage applied to said charging member in accordance with said charging potential signal and said environmental condition signal, said controlling step comprising the steps of, detecting a charging potential on said photosensitive body in response to the applied voltage applied to said charging member, producing an uncompensated target applied voltage that corresponds with a target charging potential on said photosensitive body, adjusting said uncompensated target applied voltage with said environmental condition signal to provide a compensated target applied voltage that more closely corresponds with said target charging potential, and applying said compensated applied voltage in place of said applied voltage.

20. The method of claim 19, wherein:

said step of sensing at least one environmental condition comprises, sensing a temperature, and producing a temperature signal; and said step of adjusting said uncompensated target applied voltage comprises the steps of, applying said temperature signal to a temperature compensation rule, compensating said uncompensated target applied voltage based on said temperature signal once said temperature signal has been applied to said temperature compensation rule.

21. The method of claim 20, wherein said step of applying said temperature signal to a temperature compensation rule comprises selecting said temperature compensation rule from a plurality of temperature compensation rules.

22. The method of claim 19, wherein:

said step of sensing at least one environmental condition comprises, sensing a humidity, and producing a humidity signal; and said step of adjusting said uncompensated target applied voltage comprises the steps of, applying said humidity signal to a humidity compensation rule, compensating said uncompensated target applied voltage based on said humidity signal after said humidity signal has been applied to said humidity compensation rule.

23. The method of claim 19, wherein:

said step of sensing at least one environmental condition comprises, sensing an amount of deterioration of said photosensitive body, and producing a deterioration signal; and said step of adjusting said uncompensated target applied voltage comprises the step of compensating said uncompensated target applied voltage based on said deterioration signal.

24. The method of claim 19, further comprising the steps of:

positioning said charging member against said photosensitive body when in an image forming mode of operation; and removing said charging member from said photosensitive body when in a cleaning mode of operation.

25. A method for forming an image in an image forming apparatus comprising the steps of:

applying an applied voltage to a charging member;

charging a charging surface of a photosensitive body with said charging member;

producing a light having an adjustable intensity to expose an electrostatic latent image on the charging surface of said photosensitive body;

developing said electrostatic latent image to create a visible image;

applying selectively at least two voltages to said charging member means at different times;

detecting respective detection values that correspond with said at least two voltages to provide a correlation result; and adjusting at least one of said applied voltage, said adjustable intensity of said light, and an amount of developer in said developer unit based on said correlation result.

26. The method of claim 25, further comprising the steps of:

forming a test electrostatic latent image of said charging surface, comprising the step of adjusting said applied voltage to produce a corresponding predetermined surface potential on said photosensitive body in accordance with said correlation result;

detecting an amount of developer attachment on said test electrostatic latent image; and adjusting a light intensity amount based on said amount of developer attachment so a subsequent amount of developer attachment on a subsequent electrostatic latent image matches a predetermined amount.

27. The method of claim 25, further comprising the steps of:

forming a test electrostatic latent image on said charging surface, comprising the step of adjusting said applied voltage to produce a corresponding predetermined surface potential on said photosensitive body in accordance with said correlation result;

detecting an amount of developer attachment on said test electrostatic latent image; and adjusting an amount of developer used to develop said electrostatic latent image to correspond with a predetermined image density based on said developer attachment amount detected in said detecting step.

28. The method of claim 25, further comprising the steps of:

removing said charging member from said photoconductive body; and cleaning said charging member.

* * * * *